US012791278B2

(12) United States Patent
Whinnery

(10) Patent No.: US 12,791,278 B2
(45) Date of Patent: Nov. 10, 2026

(54) SYSTEMS AND METHODS FOR FIREARM SUPPRESSION

(71) Applicant: Kotter Group, LLC, Philomath, OR (US)

(72) Inventor: David K. Whinnery, Philomath, OR (US)

( * ) Notice: Subject to any disclaimer, the term of this patent is extended or adjusted under 35 U.S.C. 154(b) by 0 days.

(21) Appl. No.: 19/068,767

(22) Filed: Mar. 3, 2025

(65) Prior Publication Data

US 2025/0277643 A1 Sep. 4, 2025

Related U.S. Application Data

(60) Provisional application No. 63/560,047, filed on Mar. 1, 2024.

(51) Int. Cl.
*F41A 21/30* (2006.01)
*F41C 7/06* (2006.01)

(52) U.S. Cl.
CPC ..... *F41A 21/30* (2013.01); *F41C 7/06* (2013.01)

(58) Field of Classification Search
CPC ..... F41A 21/30; F41A 21/32; F41A 21/325; F41A 21/34; F41A 21/36; F41A 21/38; F41C 7/06
See application file for complete search history.

(56) References Cited

U.S. PATENT DOCUMENTS

| | | | | |
|---|---|---|---|---|
| 3,399,597 | A * | 9/1968 | Perrine | F41A 21/30 89/14.4 |
| 8,015,908 | B2 * | 9/2011 | Kline | F41A 21/30 89/14.4 |
| 9,879,933 | B2 * | 1/2018 | Myers | F41A 21/48 |
| 10,184,744 | B2 | 1/2019 | Young et al. | |
| 10,184,745 | B1 | 1/2019 | Fulton | |
| 10,520,278 | B2 * | 12/2019 | Myers | F41A 21/30 |
| 11,644,265 | B1 * | 5/2023 | Oglesby | F41A 21/44 89/14.4 |
| 11,662,172 | B2 | 5/2023 | Langenbeck | |
| 11,662,175 | B1 | 5/2023 | Dustin et al. | |
| 11,920,883 | B1 * | 3/2024 | Anderson, Jr. | F41A 21/325 |
| 11,988,479 | B1 * | 5/2024 | Herring | F41A 3/72 |

(Continued)

FOREIGN PATENT DOCUMENTS

CN 109416233 A * 3/2019 ..... F41B 11/70

*Primary Examiner* — Gabriel J. Klein
(74) *Attorney, Agent, or Firm* — FisherBroyles, LLP

(57) ABSTRACT

Systems and methods for firearm suppression include a firearm suppressor structured to be coupled adjacent to and in contact with a receiver of a firearm. The suppressor comprises a baffle assembly structured to modulate exhaust gases discharged upon firing. In some embodiments, the suppressor includes a firearm adapter for concentric alignment with the firearm's barrel and a magazine clamp to maintain alignment with a tubular magazine. The baffle assembly can include an inner baffle sleeve forming a primary blast chamber and an outer tube forming a secondary blast chamber. An end cap can thread onto the inner baffle sleeve to compress the baffle stack against an internal barrel nut, ensuring secure attachment to the firearm. These systems can be adapted for various firearm types, including lever action, bolt action, pump action, semi-automatic, and fully automatic firearms.

17 Claims, 20 Drawing Sheets

(56) References Cited

U.S. PATENT DOCUMENTS

| | | | | |
|---|---|---|---|---|
| 2014/0157640 | A1* | 6/2014 | Whelan | F41C 23/16 89/14.4 |
| 2015/0090105 | A1* | 4/2015 | Pace | F41A 21/30 89/14.4 |
| 2016/0003570 | A1* | 1/2016 | Tonkin | F41A 21/30 89/14.4 |
| 2016/0010935 | A1* | 1/2016 | Clarke | F41A 21/28 29/896.2 |
| 2016/0040956 | A1* | 2/2016 | Giannelli | F41C 7/06 42/17 |
| 2017/0191779 | A1* | 7/2017 | Myers | F41A 21/48 |
| 2017/0299291 | A1* | 10/2017 | Spector | F41A 5/26 |
| 2017/0350670 | A1 | 12/2017 | Grob | |
| 2018/0238653 | A1* | 8/2018 | Kunsky | F41A 21/30 |
| 2019/0242668 | A1* | 8/2019 | Barrett | F41A 21/28 |
| 2020/0166304 | A1* | 5/2020 | Martin | F41A 21/28 |
| 2023/0288164 | A1 | 9/2023 | D'Amato | |
| 2024/0085132 | A1* | 3/2024 | Herring | F41A 3/66 |

* cited by examiner

Integral Suppressor coupled to a Rifle
Right Side View

Integral Suppressor with Outer Tube
ISO View

Integral Suppressor
ISO View

Firearm Adapter
ISO View

Firearm Adapter
Bottom View

Firearm Adapter
Top View

Firearm Adapter
Left Side View

Firearm Adapter
Proximal View

Firearm Adapter
Distal View

Firearm Adapter with Vertically Offset Bore
Proximal View

Firearm Adapter with Vertically and HorizontallyOffset Bore Proximal View

Magazine Clamp
Front View

Magazine Clamp
ISO View

Internal Barrel Nut
ISO View

Internal Barrel Nut
Front View

Internal Barrel Nut
Alternate View

Inner Baffle Sleeve
ISO View

Outer Barrel Tube
ISO View

End Cap
ISO View

Integral Suppressor coupled to a Rifle
Right Side View

SYSTEMS AND METHODS FOR FIREARM SUPPRESSION

TECHNICAL FIELD

This relates to systems and methods for firearm suppression. More specifically, the disclosure relates to integral suppressors for lever action firearms with a magazine tube. Other firearm types can be used with the integral suppressor, with those other types further disclosed and described herein.

BACKGROUND

A firearm suppressor is a device that typically attaches to the muzzle of a firearm and suppresses the discharge blast when it is fired. A suppressor generally reduces the acoustic intensity of the muzzle report and physical recoil by modulating the velocity and pressure of the gas released from the muzzle. In conventional form, a suppressor may be a detachable aftermarket accessory mounted to the muzzle, or a factory-built integral part of the barrel at the muzzle.

Firearm suppressors are typically threaded (socket, or "female" threads) and fit on the muzzle of a threaded barrel (plug, or "male" threads). A typical factory-built firearm generally must be customized at the muzzle of the barrel to accept the threads of the suppressor. However, some firearms are purpose-built at the manufacturing stage to accept threaded suppressors. One challenge with aftermarket threaded suppressors is the risk of damaging the barrel threads during field use when the suppressor is not installed. This potential thread damage may prevent the suppressor from properly securing to the barrel or prevent installation entirely. Additionally, aftermarket threaded suppressors add length to the barrel, which can be cumbersome in certain usage situations. Conventional integral suppressors purpose-built at the manufacturing stage are generally not at risk of thread damage, and they may or may not add more length to the barrel.

GENERAL DESCRIPTION

This describes an integral firearm suppressor installed at the proximal end (receiver end) of the barrel, in contrast to conventional suppressors typically mounted at the distal end (muzzle end). It is believed that this is the first integral suppressor system compatible with lever action firearms having a magazine tube. However, it should be appreciated that the suppressor system can be adapted for use with (1) various types of firearm receiver actions, including but not limited to lever action, bolt action, pump action, semi-automatic action, and fully automatic action firearms among others, and (2) various types of firearm magazines, including but not limited to tubular magazines, detachable magazines, internal magazines, box magazines, fixed magazines, drop-box magazines, drum magazines, hinged floor plate magazines, and revolving aka rotary magazines, among others.

A firearm suppressor can be structured to be coupled adjacent to and in contact with a receiver of a firearm. The firearm suppressor can be structured to modulate exhaust gases discharged when the firearm is fired. The firearm suppressor can be compatible with lever action firearms having a tubular magazine. The firearm suppressor can be compatible with firearms that are bolt action, pump action, semi-automatic action, and fully automatic action, among other firearm action types. The firearm suppressor can be compatible with magazine types including detachable, internal, box, fixed, drop-box, drum, hinged floor plate, and revolving aka rotary, among other firearm magazine types.

The firearm suppressor can be 3-D printed.

The firearm suppressor can include a firearm adapter. The firearm adapter can be structured to receive a portion of a barrel of the firearm. The firearm adapter can maintain the barrel in concentric alignment with a baffle assembly. In some embodiments, the firearm adapter can maintain the barrel in asymmetrical alignment with a baffle assembly.

The firearm suppressor can include a magazine clamp. The magazine clamp can nest inside the firearm adapter. The magazine clamp can align the barrel. The magazine clamp can maintain bore axial alignment. The magazine clamp can locate and support a magazine tube.

The firearm suppressor can include an internal barrel nut. The internal barrel nut can thread onto a threaded barrel. The internal barrel nut can operably connect the magazine clamp and firearm adapter to the barrel and receiver.

The firearm suppressor can include an inner baffle sleeve. The inner baffle sleeve can attach to the internal barrel nut. The inner baffle sleeve can act as a primary blast chamber. The inner baffle sleeve can act as a baffle retention sleeve.

The firearm suppressor can use a single core (mono-core) to manage expanding gas. The mono-core can be made from a single piece of material such as steel, titanium, aluminum alloy, metal alloys, carbon fiber, or other suitable composite material. The single core suppressor may or may not include additional baffles or other internal geometries proximate to the single core.

The firearm suppressor can include an outer tube. The outer tube can slide over the assembly. The outer tube can butt up against the firearm adapter. The outer tube can create a secondary blast chamber to capture explosive gases.

The firearm suppressor can include an end cap. The end cap can fit into the outer tube. The end cap can thread onto the inner baffle sleeve. The end cap can compress a baffle stack against the internal barrel nut. The end cap can seal on the outer tube. The firearm suppressor can be structured to allow gas to only escape through the same opening through which the bullet passes—e.g., there are no other exterior openings in the firearm suppressor through which gas can escape except the opening through which the bullet passes. The firearm suppressor can also be structured to allow gas to escape through other openings besides the one through which the bullet passes. For example, the firearm suppressor can include one or more openings in the end cap or outer tube (proximal and/or distal end) that allow gas to escape from the suppressor.

In one embodiment, a firearm suppressor is structured to be coupled adjacent to and in contact with a receiver of a firearm, wherein the firearm suppressor includes a firearm adapter coupled to a baffle assembly having an inner baffle sleeve and outer tube forming primary and secondary blast chambers, and wherein the firearm adapter is structured to receive a portion of a barrel of the firearm in concentric alignment with the baffle assembly.

In another embodiment, a firearm suppressor is structured to be coupled to a firearm having a magazine, wherein the firearm suppressor is structured to receive at least a portion of the magazine in an internal cavity of the firearm suppressor, and wherein the firearm suppressor includes a magazine clamp coupled to a firearm adapter configured to capture a portion of a barrel of the firearm in a concentric alignment.

In a further embodiment, a firearm suppressor is structured to be coupled to a firearm having a barrel, wherein the firearm suppressor is structured to entirely enclose the barrel of the firearm, and wherein the firearm suppressor includes an inner baffle sleeve structured to form a primary blast chamber and an outer tube slidably coupled to the inner baffle sleeve to form a secondary blast chamber.

The general description is provided to give a general introduction to the described subject matter as well as a synopsis of some of the technological improvements and/or advantages it provides. The general description and background are not intended to identify essential aspects of the described subject matter, nor should they be used to constrict or limit the scope of the claims. For example, the scope of the claims should not be limited based on whether the recited subject matter includes any or all aspects noted in the general description and/or addresses any of the issues noted in the background.

DESCRIPTION OF DRAWINGS

The preferred and other embodiments are described in association with the accompanying drawings in which.

DETAILED DESCRIPTION OF EMBODIMENTS

The systems and methods for firearm suppression disclosed herein may be applied to all types of firearm actions, including lever action, bolt action, semi-automatic, full-automatic, and pump action firearms, as examples. Additionally, the systems and methods for firearm suppression disclosed herein may be applied to all types of firearm magazines, including, tubular magazines, detachable magazines, internal magazines, box magazines, fixed magazines, drop-box magazines, drum magazines, hinged-floor-plate magazines, and revolving aka rotary magazines, as examples. In some embodiments, an adapter is used to adapt the firearm receiver to the shape of the suppressor. In some embodiments, the systems and methods disclosed herein include internal aspects that allow an existing firearm barrel to integrate into the suppressor baffles.

Figure 1:
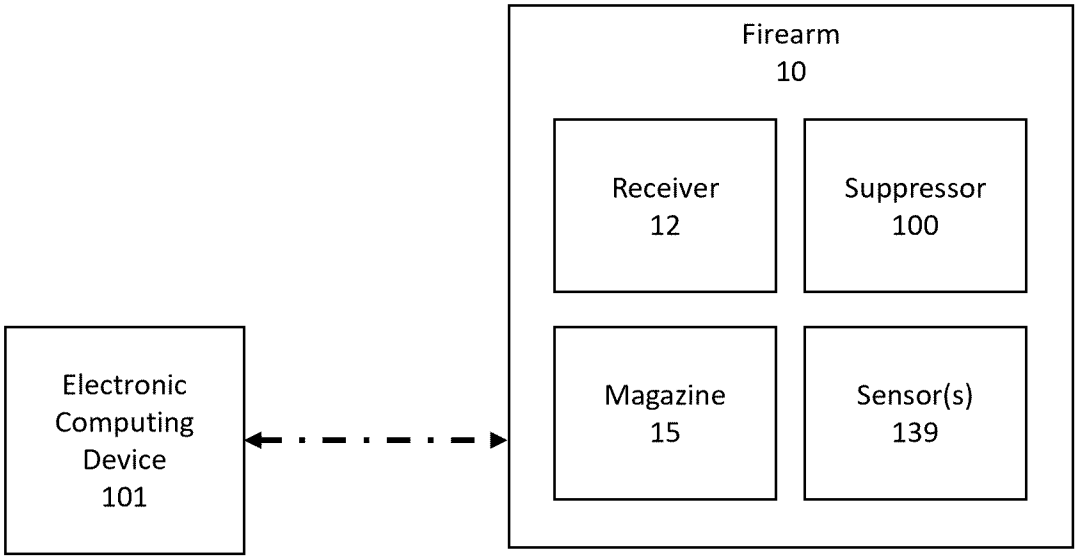
FIG. 1 is a block diagram depicting an embodiment of firearm with a suppressor.

FIG. 1 is a block diagram depicting an embodiment of a suppressor 100 and associated elements that may be integrated with, or coupled to, a firearm 10. The firearm 10 may be any handgun or rifle firearm type, or any ballistic round firing system employing a barrel, of any bore or caliber. The firearm can include a receiver 12 and have any of the following actions: lever action, bolt action, semi-automatic action, fully automatic action, and pump action. The firearm 10 can also include a magazine 15 such as any of the following types of magazines: tubular magazines, detachable magazines, internal magazines, box magazines, fixed magazines, drop-box magazines, drum magazines, hinged-floor-plate magazines, and revolving aka rotary magazines. The firearm 10 may also be a single shot firearm with no magazine 15. In some embodiments, one or more sensors 139 may be located on or about the firearm, any one or more firearm subsystems or attachments, and/or in the surrounding environment. In some embodiments, one or more electronic computing devices 101 are communicatively linked to the firearm 10. The electronic computing device(s) 101 can be coupled to the firearm 10 or positioned remote to the firearm 10.

Figure 2:
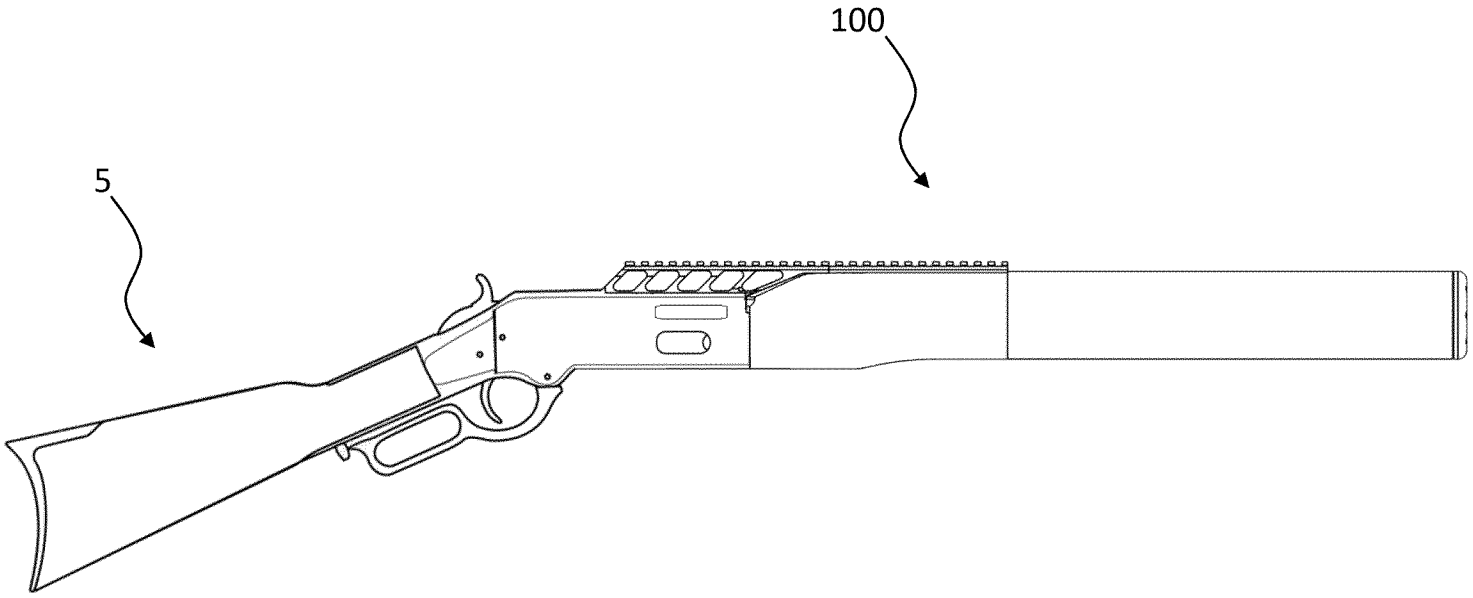
FIG. 2 depicts an embodiment of a suppressor on an exemplary firearm.

FIG. 2 depicts an embodiment of a suppressor 100 on an exemplary firearm 5. In the depicted embodiment, the firearm 5 is a lever action firearm, however, it should be clear that other adaptations are possible for different types of firearms including bolt action, semi-automatic, fully-automatic, and pump action, as examples of the many types of firearm actions. It should also be clear that other adaptations are possible for different types of firearm magazines including tubular, detachable, internal, box, fixed, drop-box, drum, hinged floor plate, and revolving aka rotary, as examples of the many types of firearm magazines. In some embodiments, the suppressor 100 may be integral to the firearm. In some embodiments, the suppressor 100 may be a modular system that can be coupled to one or more different firearms. In some embodiments, one or more of the components in the suppressor may be made of one or more of steel, steel alloys, aluminum, aluminum alloys, and carbon fiber.

Figure 3A:
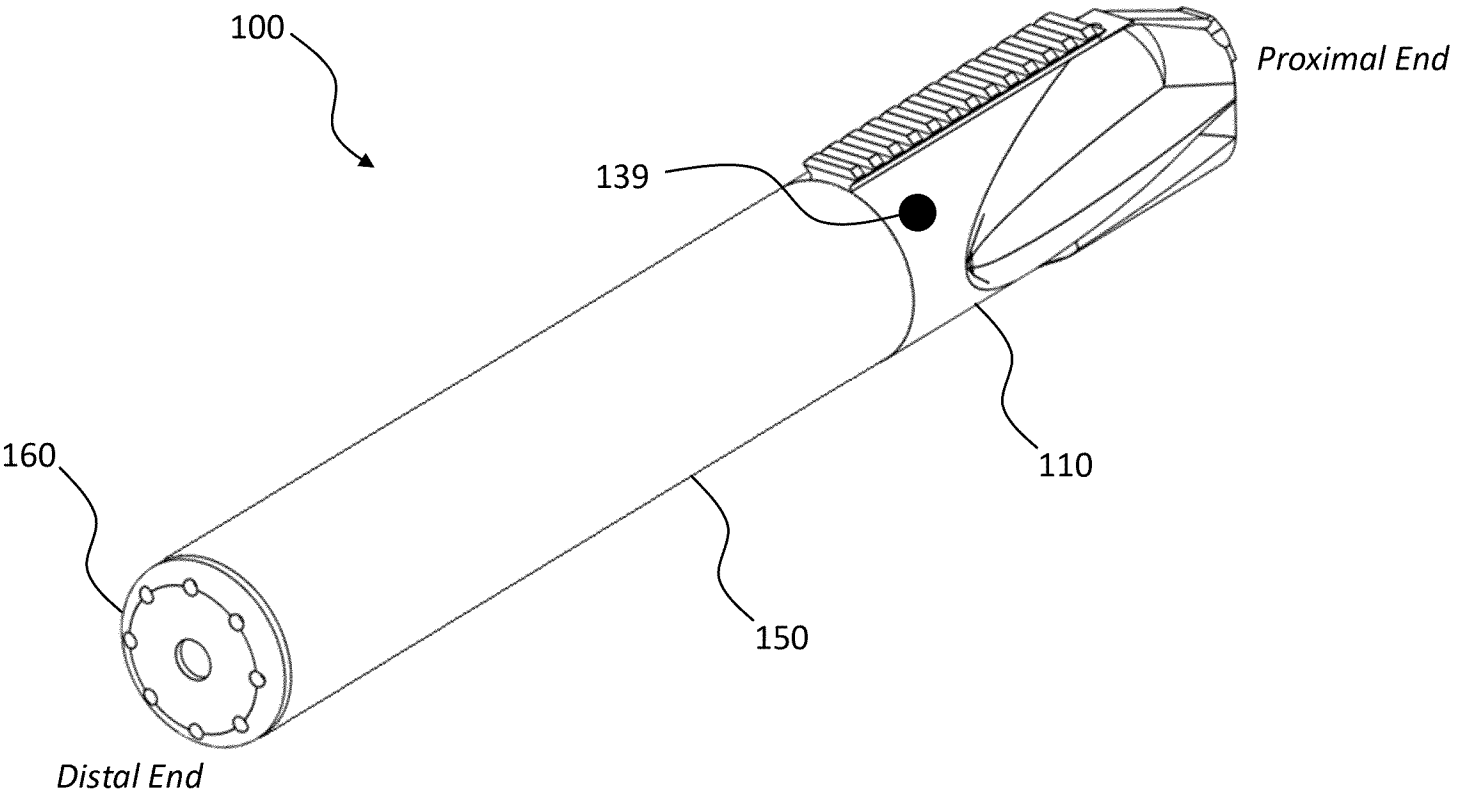
FIG. 3A depicts an isometric view of an embodiment of a suppressor.
Figure 3B:
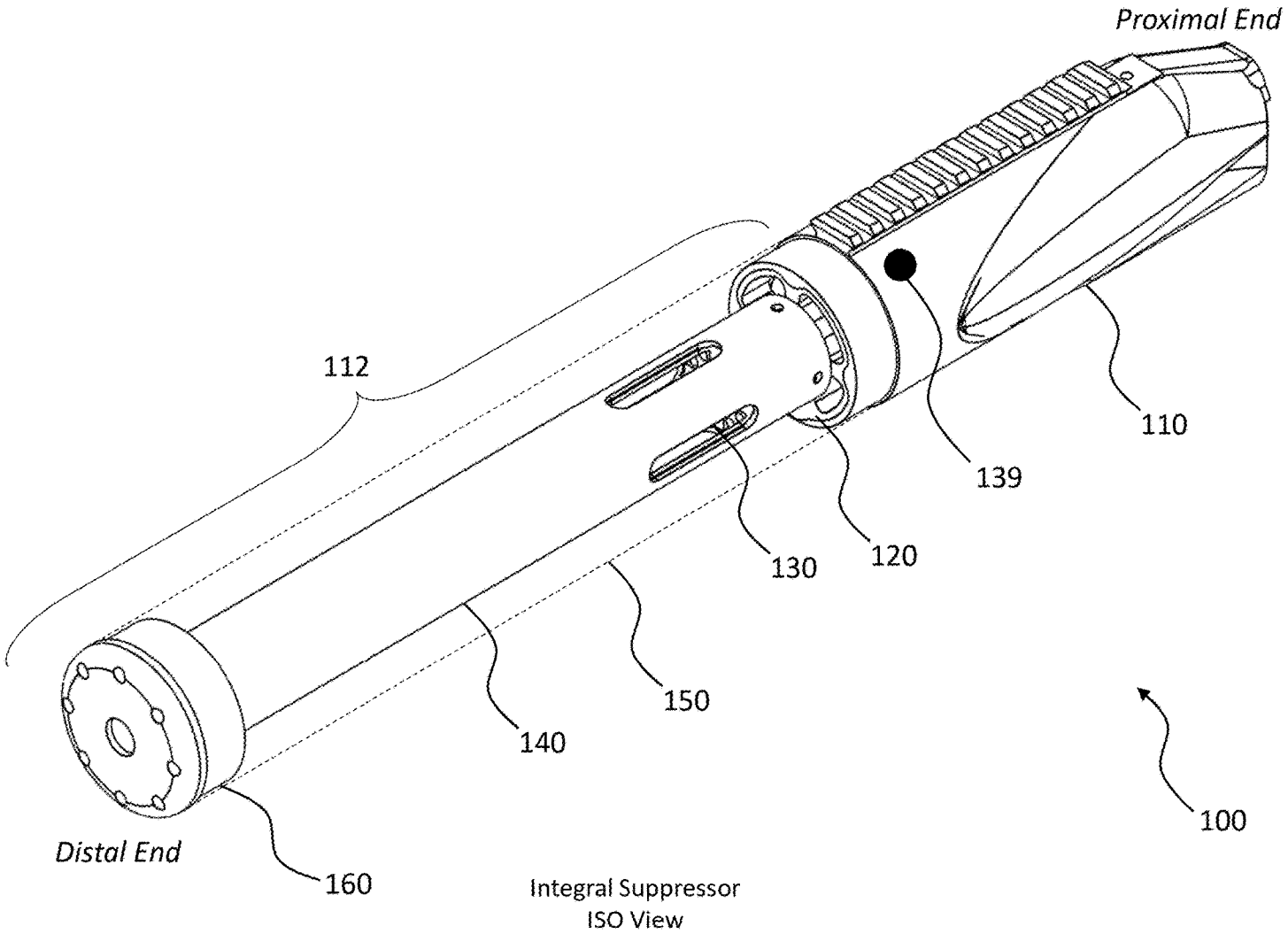
FIG. 3B depicts an isometric view of an embodiment of a suppressor.

FIGS. 3A and 3B depict isometric views of an embodiment of a suppressor 100. FIG. 3A depicts the suppressor 100 with the outer barrel tube 150 on, and FIG. 3B depicts the suppressor 100 with the outer barrel tube 150 hidden to show the components covered by the outer barrel tube 150. The depicted embodiment comprises a firearm adapter 110 and a baffle assembly 112. In the depicted embodiment, the baffle assembly 112 comprises a magazine clamp 120, an internal barrel nut 130, an inner baffle sleeve 140, an outer barrel tube 150 (alternatively referred to as an outer barrel sleeve), and an end cap 160. In some embodiments, the baffle assembly 112 may comprise one or more of a magazine clamp 120, and/or an internal barrel nut 130, and/or an inner baffle sleeve 140, and/or an outer barrel tube 150, and/or an end cap 160. In some embodiments, the baffle assembly may be a single machined part comprising the functionality of one or more of a magazine clamp 120, and/or an internal barrel nut 130, and/or an inner baffle sleeve 140, and/or an outer barrel tube 150, and/or an end cap 160.

FIGS. 4A through 4H depict various views of an embodiment of a firearm adapter 110. The firearm adapter 110 adapts the receiver of the firearm to the suppressor system 100 (FIGS. 3A and 3B). A barrel of the firearm and magazine tube may be captured inside of the firearm adapter 110 to then connect to the next component. In some embodiments, the next component may be any one of a baffle assembly 112, and/or a magazine clamp 120, and/or an internal barrel nut 130, and/or an inner baffle sleeve 140, and/or an outer barrel tube 150, and/or an end cap 160.

Figure 4A:
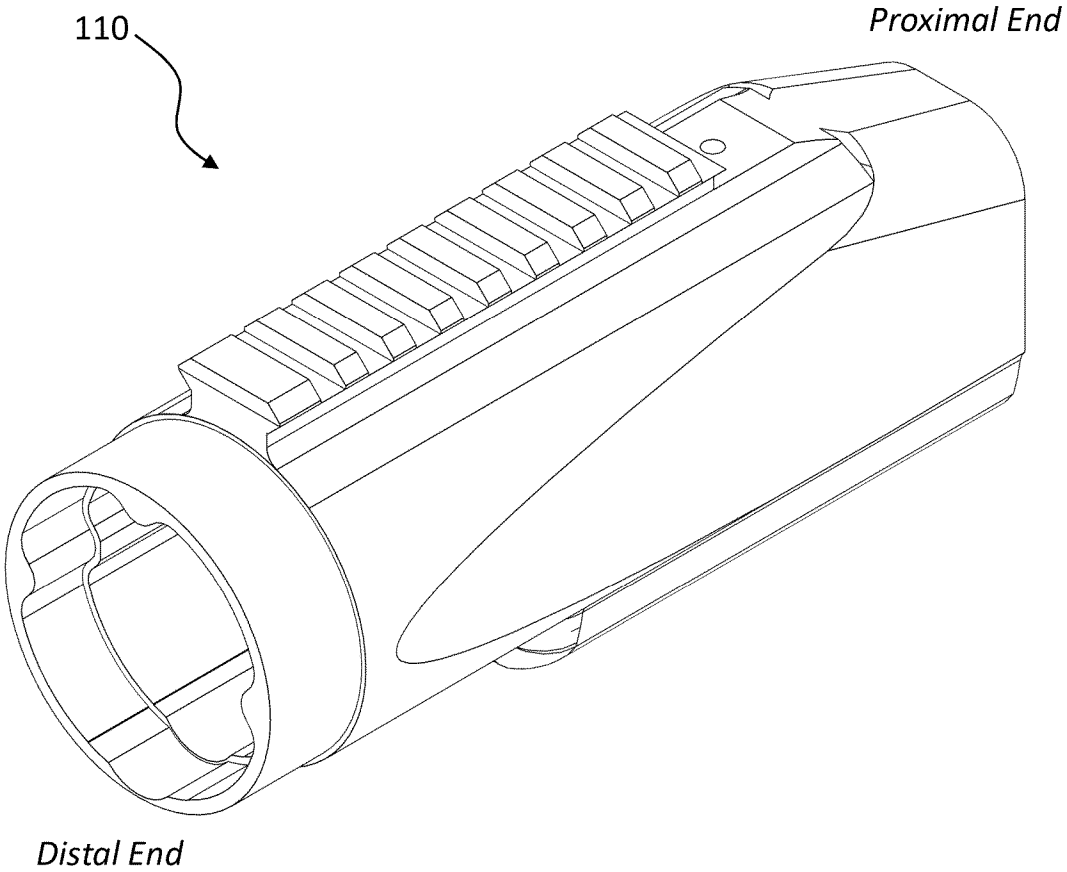
FIG. 4A depicts an isometric view of an embodiment of a firearm adapter.
Figure 4C:
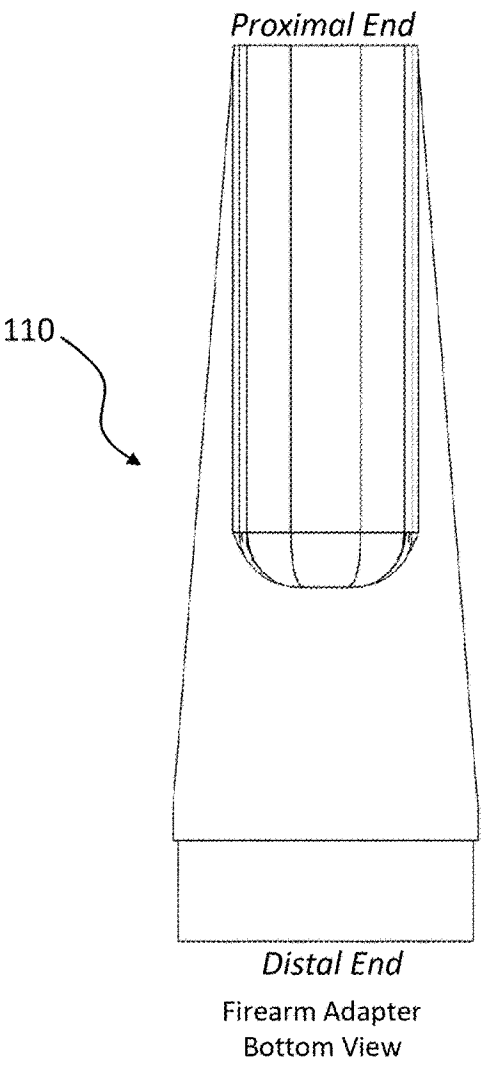
FIG. 4C depicts a bottom view of the firearm adapter embodiment of FIG. 3A.
Figure 4B:
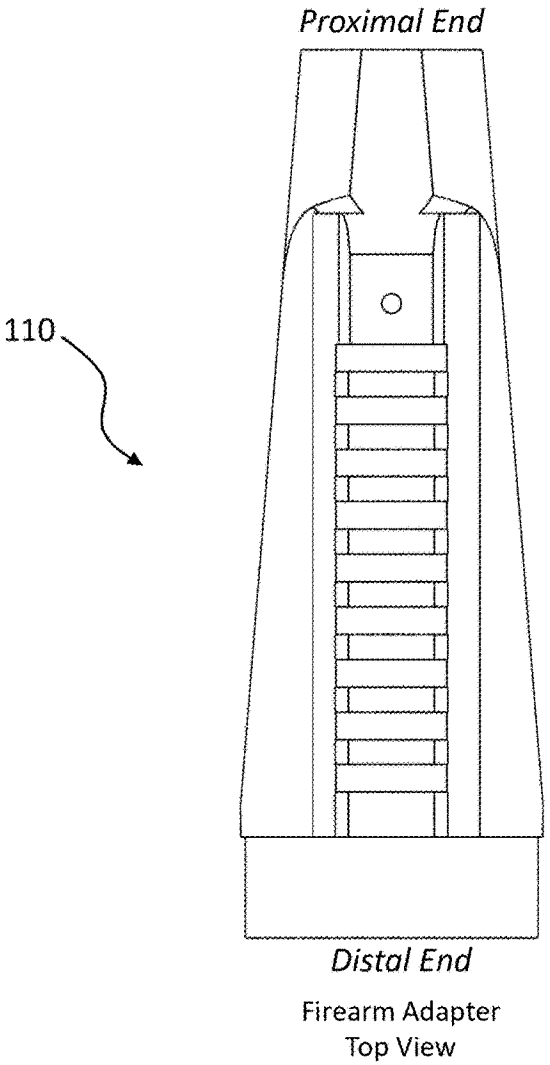
FIG. 4B depicts a top view of the firearm adapter embodiment of FIG. 3A.
Figure 4D:
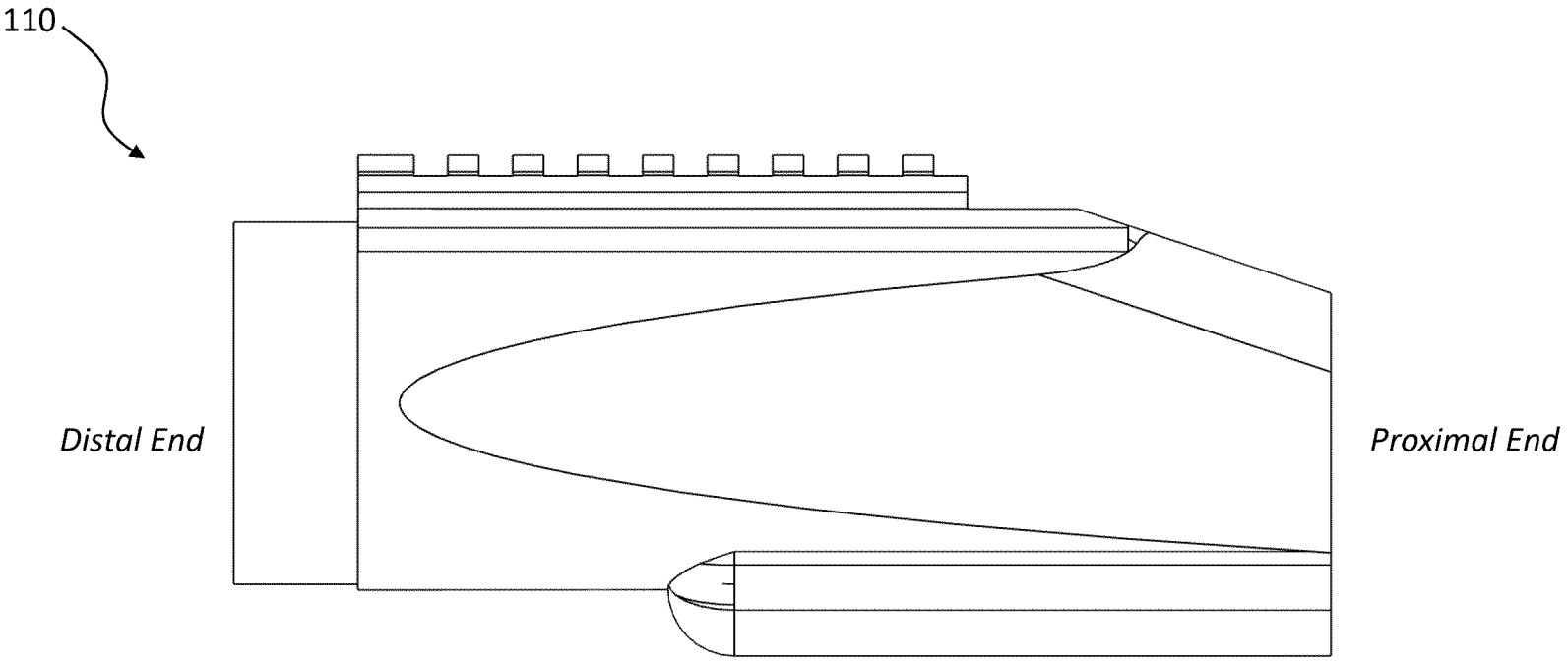
FIG. 4D depicts a right-side view of the firearm adapter embodiment of FIG. 3A.
Figure 4F:
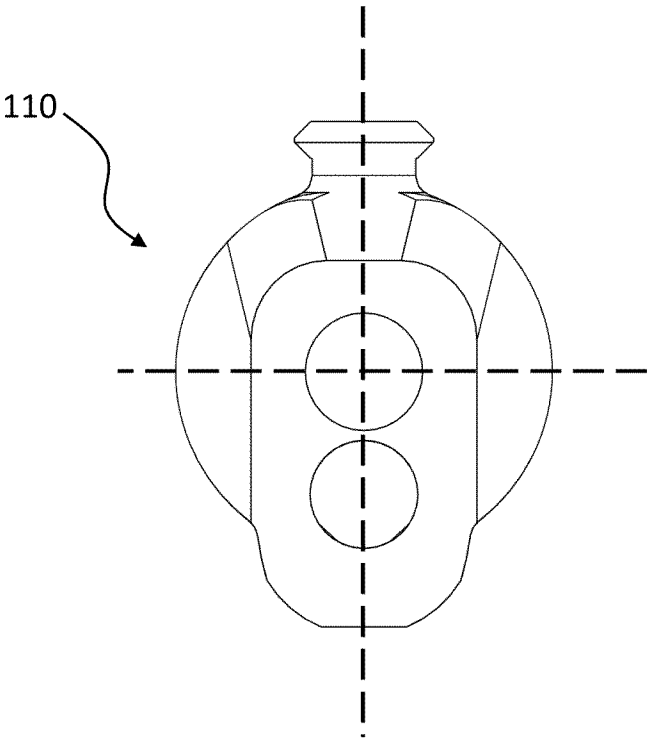
FIG. 4F depicts a proximal view of the firearm adapter embodiment of FIG. 3A including central horizontal and vertical axes.
Figure 4E:
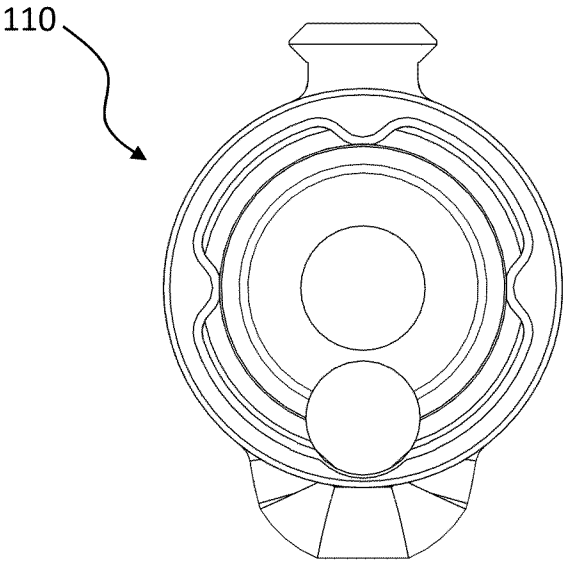
FIG. 4E depicts a distal view of the firearm adapter embodiment of FIG. 3A.
Figure 4G:
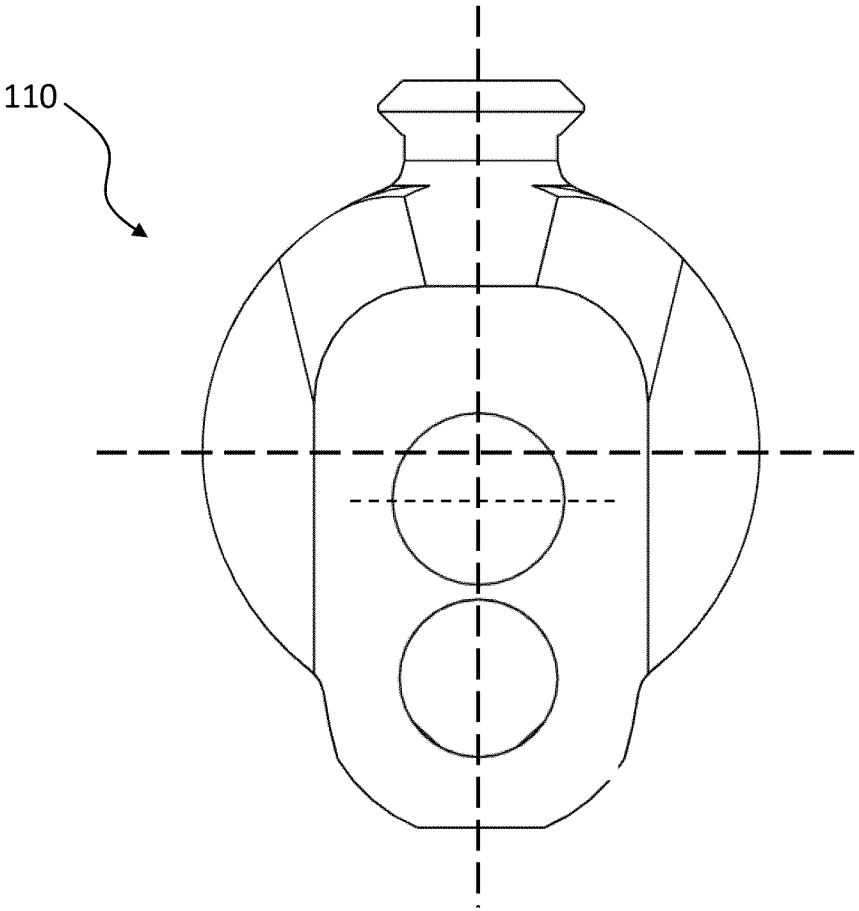
FIG. 4G depicts a proximal view of the firearm adapter embodiment of FIG. 3A wherein the bore is vertically offset from the central horizontal axis depicted in FIG. 4F.
Figure 4H:
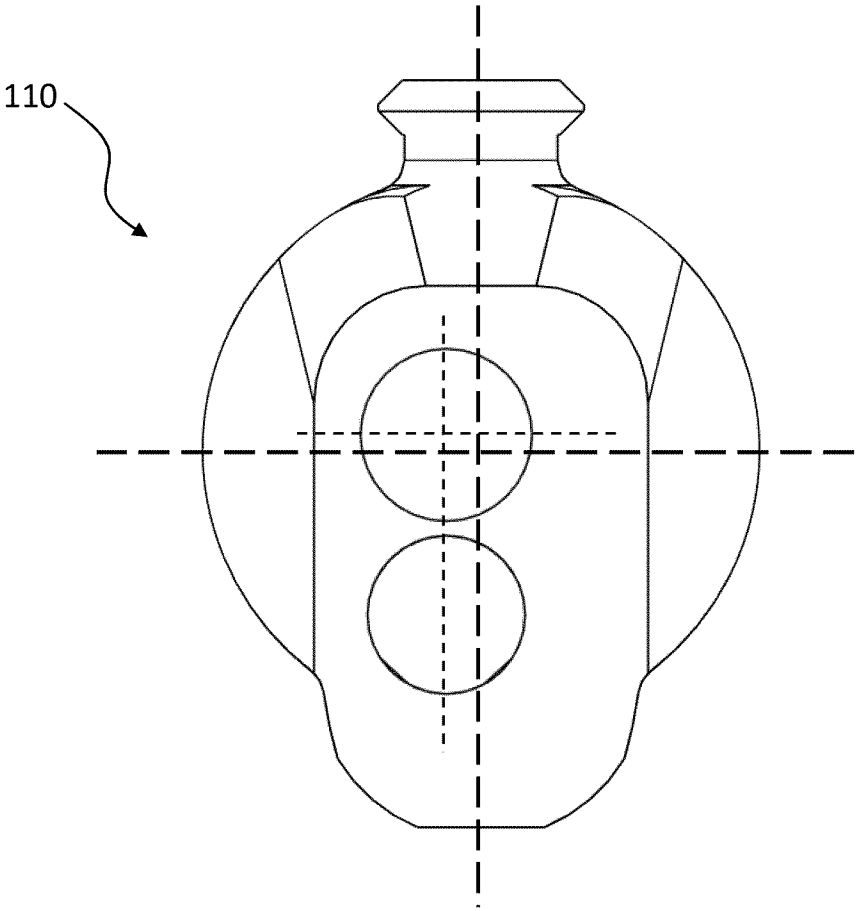
FIG. 4H depicts a proximal view of the firearm adapter embodiment of FIG. 3A wherein the bore is both vertically and horizontally offset from the central horizontal and vertical axes depicted in FIG. 4F.

In some embodiments, the alignment of the barrel is centered in the firearm adapter 110 allowing the barrel to be concentric to the bore, as depicted in FIG. 4F, which allows the system to have a concentric suppressor system 100 (FIGS. 3A and 3B). In some embodiments, the alignment of the barrel is asymmetrical to the firearm adapter 110, allowing the suppressor system 100 (FIGS. 3A and 3B) to be vertically offset from a central horizontal axis, as depicted in FIG. 4G. In some embodiments, the suppressor system 100 (FIGS. 3A and 3B) is at least one of vertically and/or horizontally offset as depicted in FIG. 4H. Other design considerations are possible.

Figure 5B:
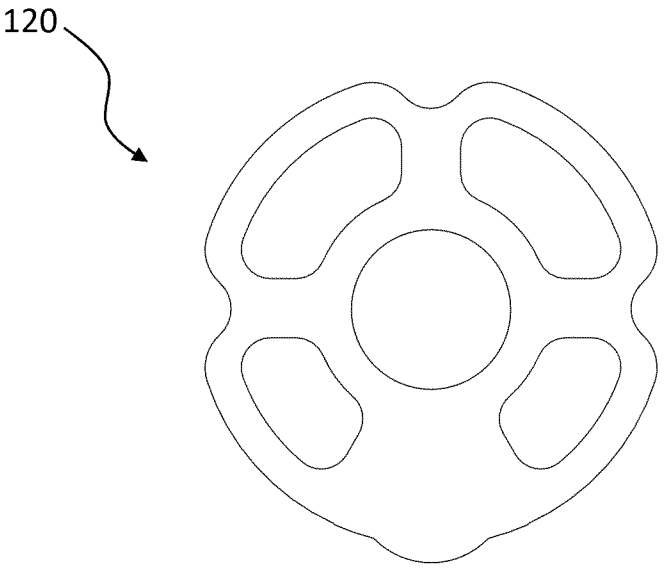
FIG. 5B depicts a front view of the magazine clamp embodiment of FIG. 4A.
Figure 5A:
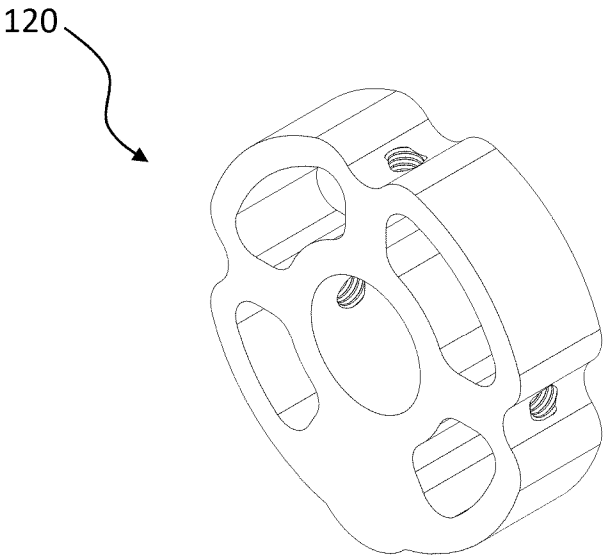
FIG. 5A depicts an isometric view of an embodiment of a magazine clamp.

FIGS. 5A and 5B depict an isometric view of an embodiment of a magazine clamp 120. The magazine clamp 120 nests inside the firearm adapter 110 (FIG. 4A through 4F) and aligns the barrel, keeps the barrel bore in axial alignment, and locates and supports the magazine tube so that they continue to function as designed for the firearm.

Figure 6A:
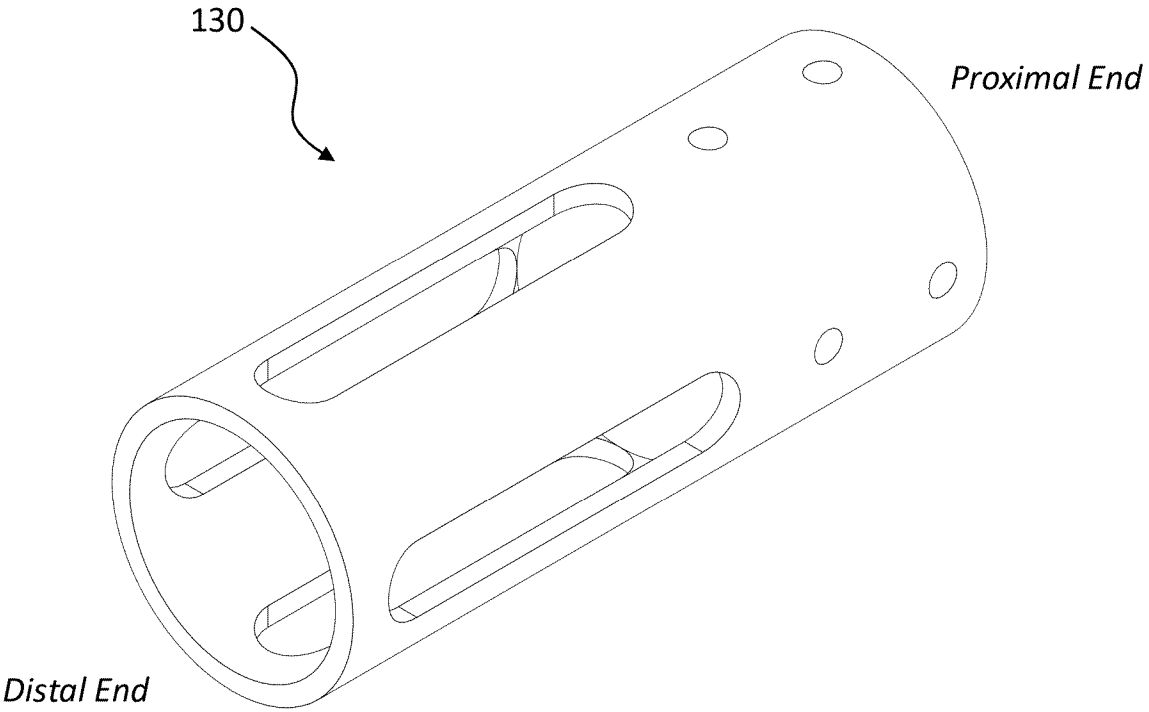
FIG. 6A depicts an isometric view of an embodiment of an internal barrel nut.
Figure 6C:
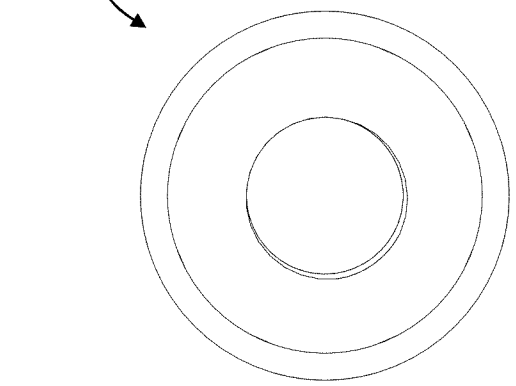
FIG. 6C depicts a front view of the internal barrel nut embodiment of FIG. 6A.
Figure 6B:
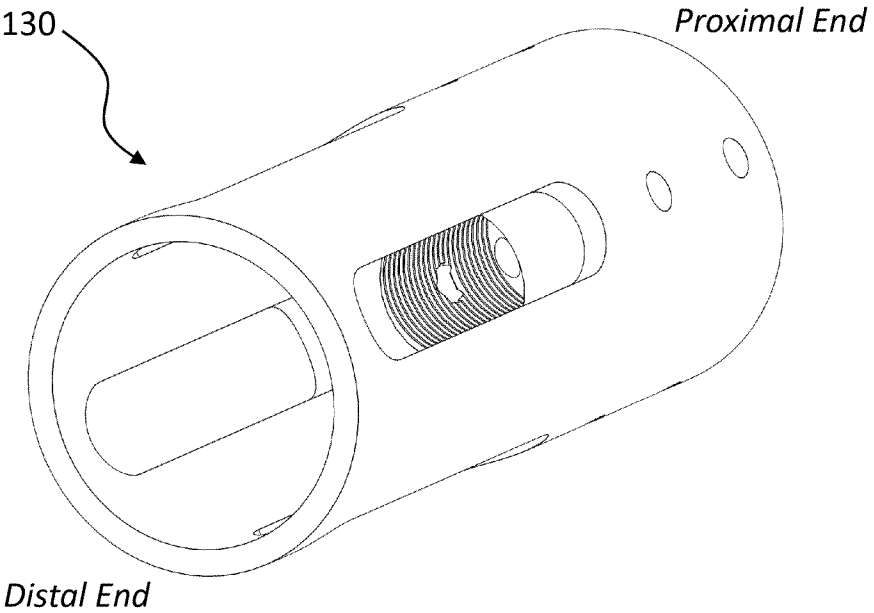
FIG. 6B depicts an alternate view of the internal barrel nut embodiment of FIG. 6A.

FIGS. 6A through 6C depict various views of an embodiment of an internal barrel nut 130. The internal barrel nut 130 threads onto the threaded barrel to operably connect the magazine clamp 120 (FIGS. 5A and 5B) and firearm adapter 110 (FIG. 4A through 4F) to the barrel and receiver. In some embodiments, once the internal barrel nut 130 is in place all the components of the original firearm and system are complete and secure, and the firearm is generally ready to fire.

Figure 7:
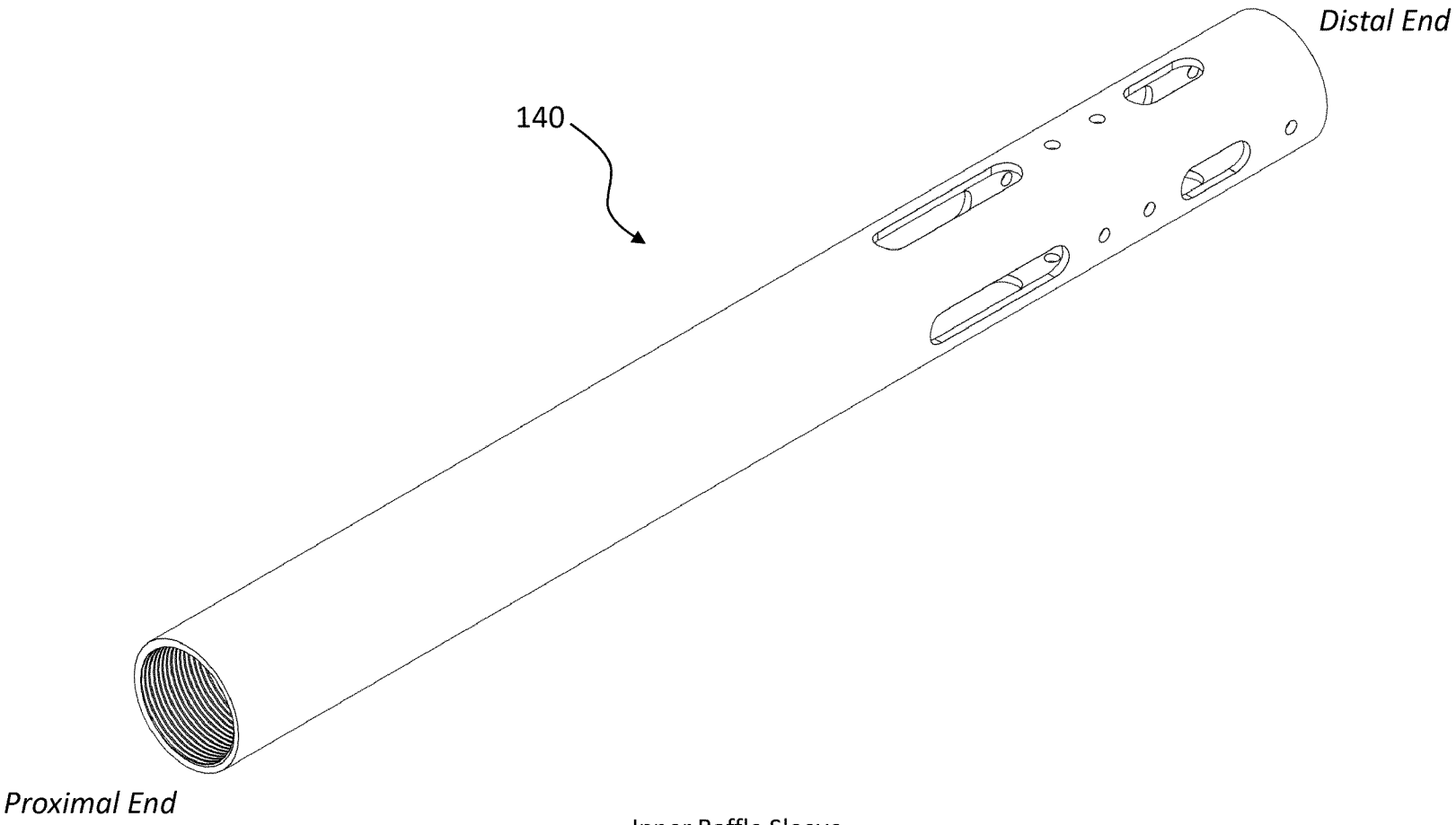
FIG. 7 depicts an isometric view of embodiment of an inner baffle sleeve.

FIG. 7 depicts an isometric view of an embodiment of an inner baffle sleeve 140. In some embodiments, the inner baffle sleeve 140 attaches to the internal barrel nut 130 (FIGS. 6A through 6C) via a slip fit secured with a fastener (e.g., a fastener such as a bolt or screw extending through corresponding aligned holes in the inner baffle sleeve 140 and the internal barrel nut 130). The slip fit allows the parts to fit together loosely and is secured by the fastener(s). Slip fits are designed to be easy to align and have minimal friction.

In some embodiments, the inner baffle sleeve 140 and the internal barrel nut 130 are coupled together in a releasable manner (or readily releasable manner) such as with the fasteners as described above. In other embodiments, the inner baffle sleeve 140 is permanently affixed to internal barrel nut 130 (FIGS. 6A through 6C) through welding or the like. Once coupled to the system, the inner baffle sleeve 140 acts as a primary blast chamber and baffle retention sleeve for suppressor system 100 (FIGS. 3A and 3B).

Figure 8:
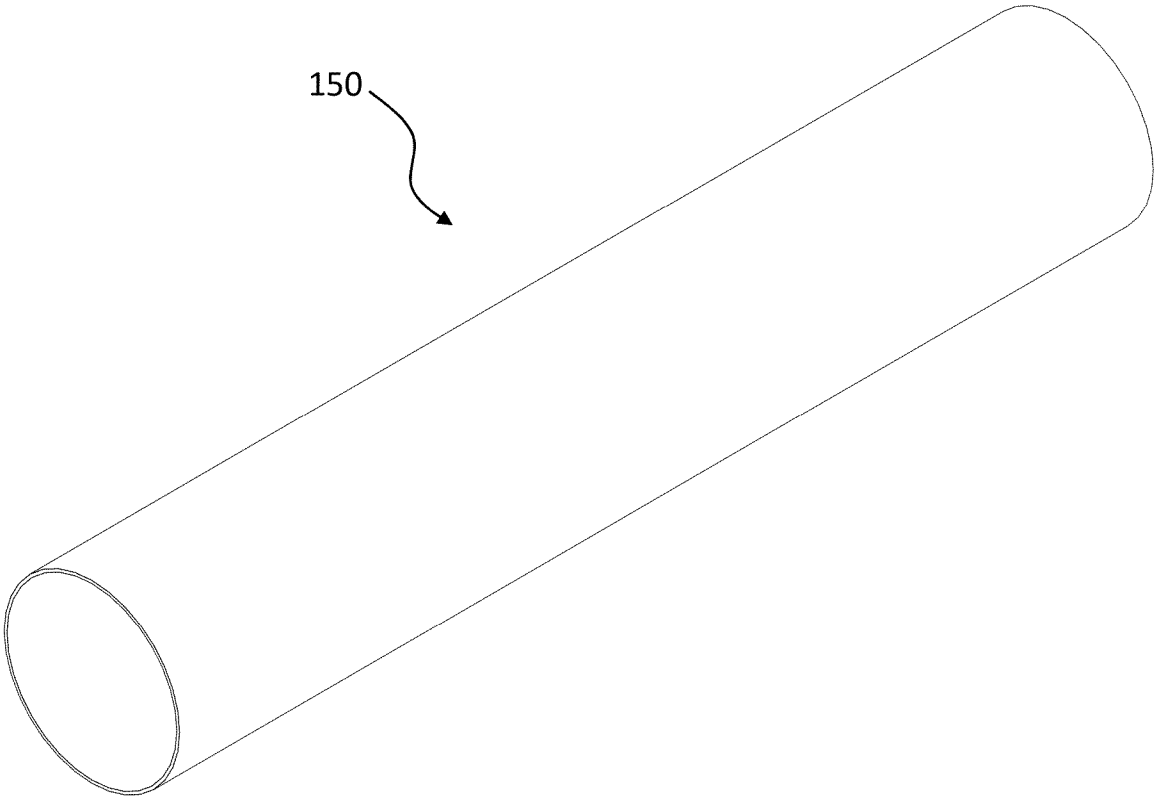
FIG. 8 depicts an isometric view of an embodiment of an outer tube.

FIG. 8 depicts an isometric view of an embodiment of an outer tube 150. The outer tube 150 slides over the entire assembly and butts up against the firearm adapter 110 (FIG. 4A through 4E) operably connecting all the parts and creating the blast chamber to capture explosive gases as a projectile is fired.

Figure 9:
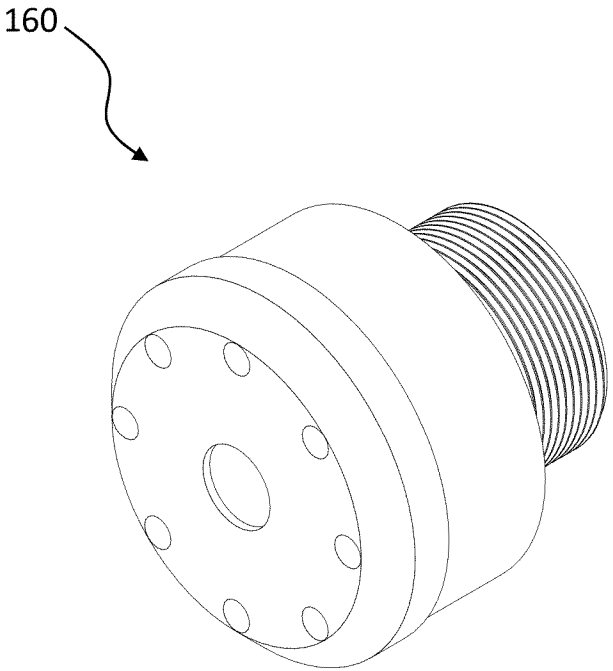
FIG. 9 depicts an isometric view of an embodiment of an end cap.

FIG. 9 depicts an isometric view of an embodiment of an end cap 160. The end cap 160 fits into the outer tube 150 (FIG. 8) and then threads onto the inner baffle sleeve 140 (FIG. 7). As it tensions it compresses the baffle stack up against the internal barrel nut 130 (FIGS. 6A through 6C) sealing on the outer tube 150 (FIG. 8). This is the complete assembly with an initial blast chamber and secondary blast chamber all connected to a firearm using a firearm adapter 110 (FIG. 4A through 4E).

Sensors

In some embodiments, as depicted in FIG. 1, one or more sensors 139 may be coupled to the suppressor 100 and/or on the firearm 10 that is coupled to the suppressor 100. Such sensors 139 may comprise one or more of pressure, velocity, time, distance, weight, dimension, image, accelerometers, and temperature sensors, among others. Some embodiments may comprise two or more of each type of sensor 139.

Pressure Measurement

In some embodiments, pressure may be measured at one or more points in the suppressor 100 and/or barrel of the firearm 10. Pressure may be measured using a variety of means comprising one or more of a conformal transducer inserted into the inner surface of the barrel of the suppressor 100 and/or the firearm 10 such that its presence does not affect the ballistics of the fired projectile. In some embodiments, pressure may be measured using an external stress gauge coupled to the outside of the suppressor 100 and/or the barrel of the firearm 10.

Velocity Measurement

In some embodiments, two or more sensors may be coupled to the suppressor 100 and/or the firearm 10 a distance apart and used as a chronograph. Each sensor is used to measure the time the projectile passes between sensor points and the velocity between points is calculated based on the distance traveled over time. The distance may vary depending on the length from the distal end of the firearm 10 muzzle to the distal end of the suppressor 100. The distance may be any distance between a minimum of 0.250" to the distance from the distal end of the firearm 10 muzzle to the distal end of the suppressor 100. In some embodiments, an additional chronograph may be extended a further distance from the distal end of the suppressor coupled using a rigid support.

In some embodiments, one or more sensors 139 may measure the distance between the distal end of the suppressor 100 and the target. In some embodiments, one or more sensors 139 may measure the position of the distal end of the suppressor 100 at the time the projectile exits. In some embodiments, one or more sensors 139 may measure the position of the projectile impact.

In some embodiments, the data from the two sensor locations is cross-compared to arrive at aim-adjustment suggestions for the firearm operator through a Bluetooth enabled app.

Figure 10:
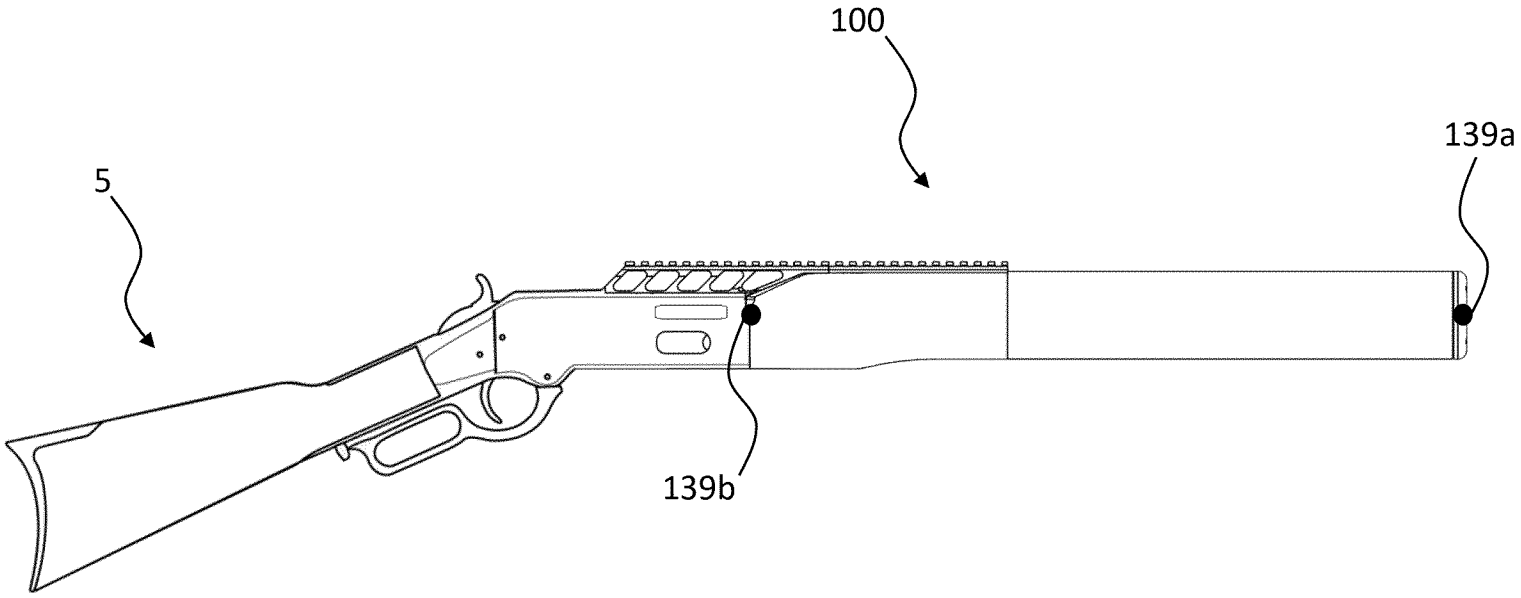
FIG. 10 depicts possible sensor locations for an embodiment of the suppressor coupled to a rifle.

In some embodiments, data from two discrete sensor locations is gathered and subsequently compared to generate suggestions for adjusting the firearm operator's aim. An embodiment comprising two sensors is depicted in FIG. 10. In the depicted embodiment, the sensors 139*a*, 139*b* are represented generically merely to indicate general possible positions. The size, form, and exact position of each sensor may vary. One sensor 139*a* can be positioned near the distal end of the barrel to capture parameters associated with the projectile's exit—such as exit velocity, muzzle angle, and real-time departure position—while a second sensor 139*b* can independently record parameters indicative of the projectile's flight path and impact location. The system's processor analyzes the data captured from each sensor and correlates the information to determine any deviation between the intended and actual trajectories. For example, the sensor near the suppressor can provide initial shot metrics, whereas the sensor positioned closer to the target can reveal how environmental factors or initial alignment discrepancies may have affected the projectile's travel. The cross-comparison of these sensor data sets allows the electronic computing device to calculate error margins in both horizontal and vertical axes.

Based on these calculations, the system derives aim-adjustment suggestions that could include recommended shifts in windage or elevation. The computed suggestions can be transmitted via a Bluetooth-enabled connection to a paired application on a mobile device, tablet, or similar electronic computing device. In this app, the firearm operator can view real-time feedback, such as digital indicators or graphical overlays, that communicate how the aim should be adjusted to compensate for observed deviations.

Additional embodiments can further refine these suggestions by integrating supplemental sensor data—such as ambient temperature measurements, wind speed, and even positional information—to improve the accuracy of the adjustments. The continuous or periodic recalculation of sensor data allows the aim-correction recommendations to be updated dynamically throughout a shooting session, thereby providing the firearm operator with timely feedback that adapts to changing conditions. This comparison strategy not only facilitates improved shot accuracy but also offers a robust method for continuously monitoring and adjusting the firearm's performance in real-time.

Temperature

Temperature is an important factor in ballistics. In some embodiments, one or more temperature sensors may be used to measure ambient temperature.

Wind

In some embodiments, wind speed and direction may be monitored. Wind data may be utilized to factor its effect on the ballistics of each shot fired.

Monitoring and Display

In some embodiments, sensor data from the one or more sensors may be monitored on an electronic computing device. In some embodiments, the computing device may be a mobile phone, tablet, or laptop. In some embodiments, the sensor data and/or data derived from the sensor data may be recorded and/or presented on the computing device.

In some embodiments, sensor data is conveyed via Bluetooth to a computing device comprising a proprietary software application available for download to the computing device.

In some embodiments, data obtained from one or more sensors integrated into or proximate to the suppressor and/or firearm is transmitted wirelessly via Bluetooth to a computing device. The sensor data—which can include measurements such as pressure, velocity, temperature, position, and other ballistics-related parameters—is encoded and sent as a digital data stream over a Bluetooth connection. In these embodiments, Bluetooth is employed as a low-energy, reliable wireless transmission protocol that allows the sensors to remain coupled to the suppressor and/or firearm while ensuring real-time data communication without the need for direct physical wiring between the sensors and the computing device.

The computing device can be any suitable device capable of running a dedicated software application, such as a mobile phone, tablet, or laptop. The device is installed with a proprietary software application that is available for download from an appropriate application store or similar source. This proprietary software is designed to interface with the Bluetooth data stream, receive the sensor signals, and process the data using one or more algorithms that analyze the shot parameters. The software can provide real-time analysis by correlating the sensor readings with predetermined performance metrics, enabling functionality such as shot profiling, ballistic evaluation, and real-time shot correction suggestions.

Further, the proprietary software application offers a user interface that displays the processed sensor data in graphical and/or numerical formats, allowing the firearm operator to monitor operational parameters during or after firing sessions. This can include showing trends in parameters like projectile velocity variations, muzzle alignment, and environmental influences such as wind or ambient temperature, which can all contribute to aiming performance. In addition, the application can store historical sensor data so that long-term performance evaluations and adjustments can be made. The use of Bluetooth for data transmission coupled with the proprietary software thus provides a modular framework where sensor data is seamlessly integrated into the computing device, enabling continuous monitoring and dynamic feedback for improved shot accuracy.

Electronic Computing Device

Figure 11:
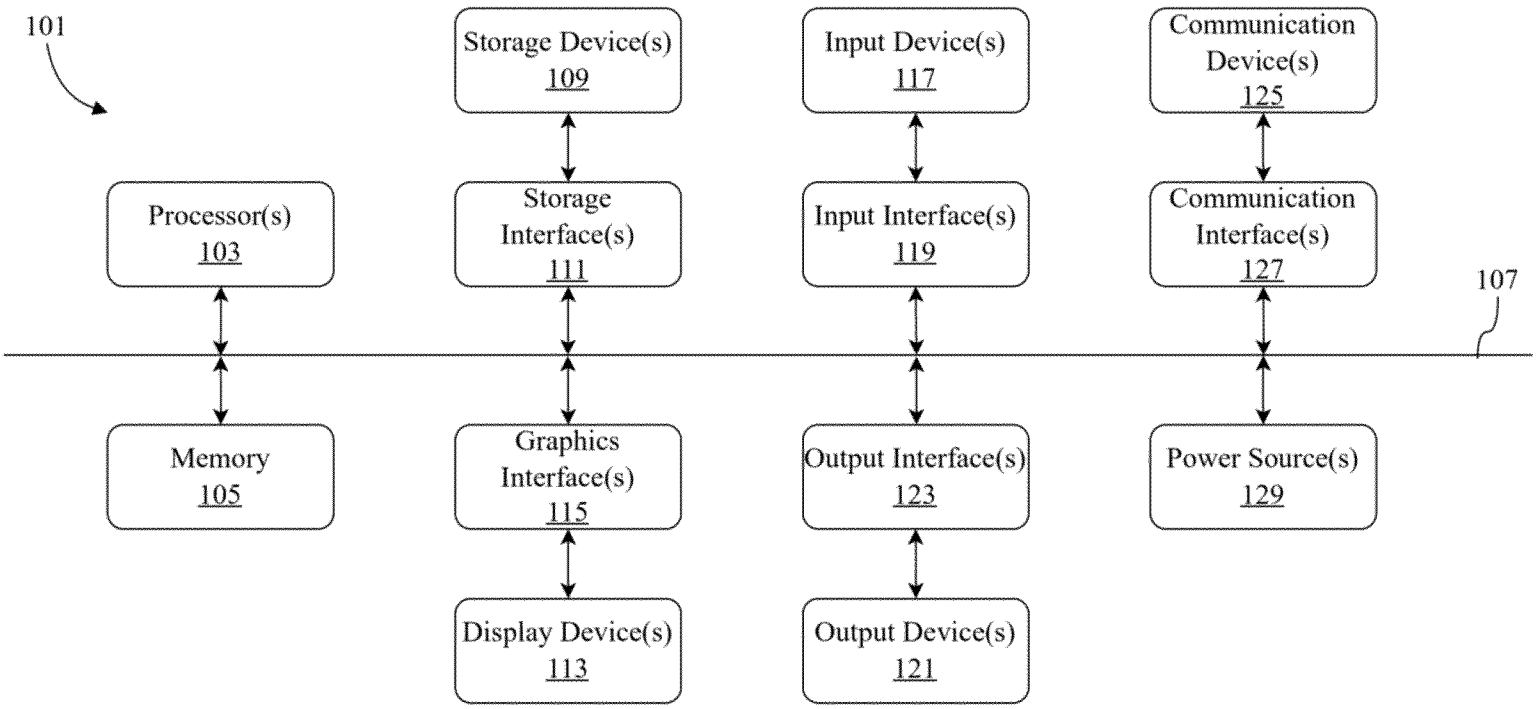
FIG. 11 shows one embodiment of an electronic computing device that can used with or as part of the firearm suppressor.
Figure 12:
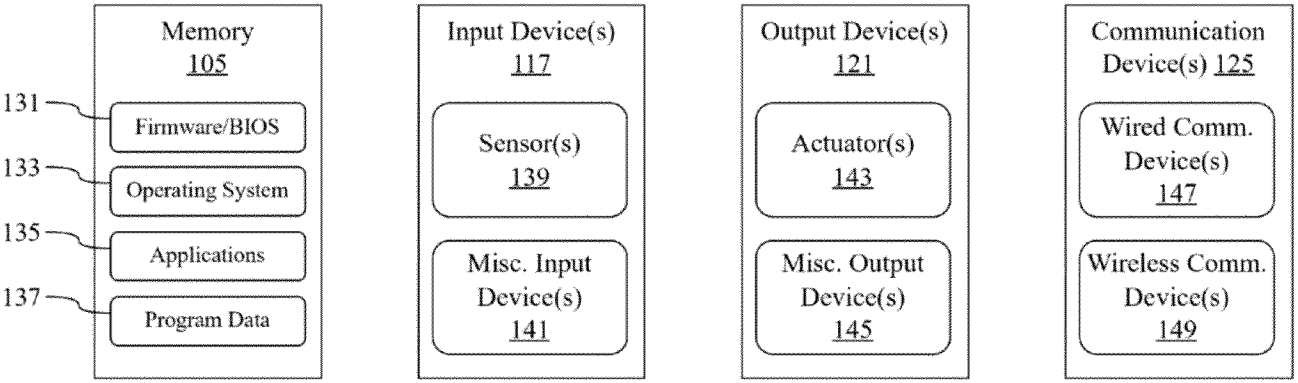
FIG. 12 shows various embodiments of the devices that can be included as part of the electronic computing device in FIG. 10.

FIG. 11 shows one embodiment of an electronic computing device 101 (alternatively referred to as an electronic controller, programmable logic controller, electronic control system, or electronic computing system) that can be used in conjunction with the one or more sensors in or proximate to the firearm 10 (FIG. 1) or the suppressor 100 (FIGS. 3A and 3B). The sensors receive the data and send the data via Bluetooth to a software application on a computing device. In some embodiments, the data may be used for the firearm operator to make adjustments to ammo selection, shooting position, windage, elevation, and/or other factors that may affect target acquisition. FIG. 12 shows embodiments of the devices that can be included as part of the electronic computing device 101.

The electronic computing device 101 includes one or more processors 103 (alternatively referred to as a digital processing unit or microprocessor) and memory 105 communicatively linked to each other by way of a system bus 107. In some embodiments, the electronic computing device 101 can also include one or more other interfaces and/or devices communicatively linked to the system bus 107.

In some embodiments, the electronic computing device 101 may be configured to calculate ballistic data for a particular projectile. This functionality may be of use to a reloader who reloads spent casings or to a firearm operator who needs to test projectile specifications. In some embodiments, the electronic computing device may utilize published ballistic specifications to aid in calculations and estimates provided to the firearm operator.

In some embodiments, the electronic computing device 101 may use data from one or more sensors to generate a firearm operator profile. A firearm operator profile may gather data and/or information relevant to one or more of number of firing sessions, number of shots per session, numbers and types of firearms used per session, details on types and quantities of ammo used, environmental data, firearm and/or projectile preference, and firing accuracy. Firing accuracy may include one or more of general accuracy level for all firearms used, accuracy per session, accuracy specific to firearm type and/or a specific firearm, and accuracy specific to a projectile type. One or more firearm operator profiles may be generated and stored locally or remotely. The firearm operator may configure their profile to at least one of track and display the parameters and information they select. Firearm operators may toggle between profiles or the electronic computing device 101 may automatically select a profile when it detects a new or existing firearm operator.

For example, one or more storage devices 109 can be communicatively linked to the system bus 107 by way of one or more storage interfaces 111. One or more display devices 113 can be communicatively linked to the system bus 107 by way of one or more graphics interfaces 115. One or more input devices 117 can be communicatively linked to the system bus 107 by way of one or more input interfaces 119. One or more output devices 121 can be communicatively linked to the system bus 107 by way of one or more output interfaces 123. One or more communication devices 125 can be communicatively linked to the system bus 107 by way of one or more communication interfaces 127.

It should be appreciated that the electronic computing device 101 can have a variety of configurations. For example, in some embodiments, the various components of the electronic computing device 101 can be positioned near each other in one or more housings and on a single circuit board or multiple circuit boards communicatively linked together, or the like. In other embodiments, the various components of the electronic computing device 101 can be located remotely. For example, the one or more input devices 117 and/or the one or more output devices 121 can be located remotely or at a distance from the one or more processors 103 and/or the memory 105.

Processor

Each of the one or more processors 103 is an electric circuit such as an integrated circuit that executes program instructions. The processor 103 can perform operations such as arithmetic operations, logic operations, controlling operations, and input/output (I/O) operations specified by the program instructions. In some embodiments, the processor 103 includes a control unit (CU), an arithmetic logic unit (ALU), and/or a memory unit (alternatively referred to as cache memory).

The control unit can direct the operation of the processor 103 and/or instruct the memory 105, arithmetic logic unit, and output devices 121 how to respond to instructions in the program. It can also direct the flow of data or information between the processor 103 and other components of the electronic computing device 101. It can also control the operation of other components by providing timing and control signals.

The arithmetic logic unit is an electric circuit in the processor 103 that performs integer arithmetic and bitwise logic operations. The arithmetic logic unit receives input in the form of data or information to be operated on and code describing the operation to be performed. The arithmetic logic unit provides the result of the performed operation as output. In some configurations, the arithmetic logic unit can also include status inputs and/or outputs that convey information about a previous operation or the current operation between the arithmetic logic unit and external status registers.

It should be appreciated that the processor 103 can have any suitable configuration. For example, the processor 103 can range from a simple processor specially built or configured to execute one or more programs for a specific application or device to a complex central processing unit configured to be used in a wide variety of ways and an equally wide variety of applications. Examples of processors 103 include a general-purpose processor, a digital signal processor (DSP), an application specific integrated circuit (ASIC), a central processing unit (CPU), a field programmable gate array (FPGA) or other programmable logic device (PLD), and/or discrete gate or transistor logic. The processor 103 can also be implemented as any one or combination of these devices.

Memory

The memory 105 (alternatively referred to as primary memory, main memory, or a computer-readable medium) is a semiconductor device or system used to store information for immediate use by the processor 103. The memory 105 is generally directly accessible to the processor 103. The processor 103 can read and execute program instructions stored in the memory 105 as well as store data and/or other information in the memory 105 that is actively being operated on. The memory 105 is generally more expensive and operates at higher speeds compared to the storage device 109. The memory 105 can be volatile such as random-access memory (RAM) or non-volatile such as read-only memory (ROM).

System Bus

The system bus 107 broadly refers to the communication system through which information is transferred between the processor 103, the memory 105, and/or other components such as peripherals that can be considered part of the electronic computing device 101. The system bus 107 can include a physical system of connectors, conductive pathways, optical pathways, wires, or the like through which information travels.

The system bus 107 can have a variety of physical configurations. In some embodiments, the system bus can be configured as a backbone connecting the processor 103, the memory 105, and/or the various devices and/or interfaces as shown in the figure. In other embodiments, the system bus 107 can be configured as separate buses that communicatively link one or more components together. For example, the system bus 107 can include a bus communicatively linking the processor 103, the memory 105, and/or circuit board (the bus can alternatively be referred to as the front-side bus, memory bus, local bus, or host bus). The system bus 107 can include multiple additional I/O buses communicatively linking the various other devices and/or interfaces to the processor 103.

It should be appreciated that information shared between the components of the electronic computing device 101 can include program instructions, data, signals such as control signals, commands, bits, symbols, or the like. The information can be represented using a variety of different technologies and techniques. For example, in some embodiments, the information can be represented by voltages, currents, electromagnetic waves, magnetic fields or particles, optical fields, or the like.

The system bus 107 can also be used for other purposes besides sharing information. For example, the system bus 107 can be used to supply power from the power source 129 to the various devices and/or interfaces connected to the system bus 107. Likewise, the system bus 107 can include address lines which match those of the processor 103. This allows information to be sent to or from specific memory locations in the memory 105. The system bus 107 can also provide a system clock signal to synchronize the various devices and/or interfaces with the rest of the system.

The system bus 107 can use a variety of architectures, communication protocols, or protocol suites to communicatively link the processor 103, the memory 105, and/or any of the other devices and/or interfaces. For example, suitable architectures include Industry Standard Architecture (ISA), Extended Industry Standard Architecture (EISA), Micro Channel Architecture (MCA), Video Electronics Standards Association (VESA), Peripheral Component Interconnect (PCI), PCI Express (PCI-X), Personal Computer Memory Card Industry Association (PCMCIA or PC bus), Accelerated Graphics Port (AGP), Small Computer Systems Interface (SCSI), and the like. Suitable communication protocols include TCP/IP, IPX/SPX, Modbus, DNP, BACnet, ControlNet, Ethernet/IP, or the like.

Program Instructions

The instructions stored in the electronic computing device 101 can include software algorithms and/or application programs. It should be appreciated that the software algorithms can be expressed in the form of methods or processes performed in part or entirely by the electronic computing device 101 or as instructions stored in a computer-readable medium such as the memory 105 and/or the storage device 109. Likewise, the software algorithms are shown in the flowcharts and described in the methods and/or processes.

It should be appreciated that instructions can take the form of entirely software (including firmware, resident software, micro-code, or the like), entirely hardware, or a combination of software and hardware. If implemented in software executed by the processor 103, the information may be stored on or transmitted over a computer-readable medium such as the memory 105 and/or the storage device 109. In some embodiments, the instructions can be contained in any tangible medium of expression having program code embodied in the medium. In some embodiments, the instructions can be written in any combination of one or more programming languages, which can be text-based or graphical languages.

It should also be appreciated that the flowcharts, block diagrams, methods, and/or processes describe algorithms and/or symbolic representations of information operations. The algorithmic descriptions and representations are the means used by those skilled in the data processing arts to convey the substance of their work most effectively to others skilled in the art. These operations, while described functionally or logically, are understood to be implemented by software and/or hardware that can be readily and easily created from the functional or logical descriptions of the algorithms.

For example, the instructions can include an algorithm for making a decision—e.g., determining whether a parameter satisfies one or more conditions and performing various operations based upon the parameter satisfying the one or more conditions. This can be represented in the instructions with a conditional statement or conditional expression written in a programming language. An example of such a conditional statement or expression is shown below. It should be appreciated that the syntax for the conditional statement or expression will vary depending on the chosen programming language.

```
if condition1 satisfied then
   perform operation 1
elseif condition2satisfied then
   perform operation 2
elseif condition3satisfied then
   perform operation 3
else
   perform operation 4;
end if;
```

The instructions can be used to perform a variety of operations. For example, the instructions can be used to control the receipt and processing of data from the input devices 117. The instructions can also be used to control hardware such as any of the output devices 121.

In some embodiments, the instructions can include firmware such as a basic input/output system (BIOS) 131, an operating system 133, one or more application programs 135, program data 137, and the like. These can be stored in the memory 105 and/or the storage device 109. In general, the instructions are stored in the memory 105 when the electronic computing device 101 is on and running or while the instructions are being used (e.g., an application program is running). Likewise, the instructions are stored in the storage device 109 when the electronic computing device 101 is off.

In some embodiments, the instructions are used to provide data and/or information to a firearm operator regarding one or more of target acquisition, aim, guidance, accuracy, number of projectiles fired and/or shot comparison over time, muzzle energy, muzzle velocity, actual and/or estimated projectile trajectory, windage, elevation, decibel level, and other data and/or information relevant to the operation of a firearm or the firearm operator.

Storage Device

Each of the one or more storage devices 109 (alternatively referred to as secondary memory, or a computer-readable medium) is a device or system used to store information that is not needed for immediate use by the processor 103. The storage device 109 can be communicatively linked to the system bus 107 by way of a storage interface 111. The storage device 109 is generally not directly accessible to the processor 103. The storage device 109 is generally less expensive and operates at lower speeds compared to the memory 105. The storage device 109 is also generally non-volatile and used to permanently store the information.

The storage device 109 can take a variety of physical forms and use a variety of storage technologies. For example, in some embodiments, the storage device 109 can be in the form of a hard disk storage device, solid-state storage device, optical storage device, or the like. Also, in some embodiments, the storage device 109 can use technologies such as a magnetic disk (e.g., disk drives), laser beam (e.g., optical drives), semiconductor (e.g., solid-state drives), and/or magnetic tape to store information.

Display Device

Each of the one or more display devices 113 (alternatively referred to as a human-machine interfaces (HMI) or screens) is a device that visually conveys text, graphics, video, and/or other information. In some embodiments, the information shown on the display device 113 exists electronically and is displayed for a temporary period of time. It should be appreciated that the display device 113 can operate as an output device and/or input device (e.g., touchscreen display or the like).

The display device 113 can be communicatively linked to the system bus 107 by way of one or more graphics interfaces 115. In some embodiments, the graphics interface 115 can be used to generate a feed of output images to the display device 113. In some embodiments, the graphics interface 115 can be a separate component such as a dedicated graphics card or chip or can be an integrated component that is part of or a subset of the processor 103.

It should be appreciated that the display device 113 can include a variety of physical structures and/or display technologies. For example, in some embodiments, the display device 113 can be a screen integrated into a specific application or technology, a separate screen such as a monitor, or the like. The display device 113 can also be a liquid crystal display, a light emitting diode display, a plasma display, a quantum dot display, or the like.

Input Devices

Each of the one or more input devices 117 is a physical component that provides information to the processor 103 and/or the memory 105. The input device 117 can be communicatively linked to the system bus 107 by way of one or more input interfaces 119. The input device 117 can be any suitable type and can provide any of a variety of information. For example, the input device 117 can be a digital and/or analog device and can provide information in a digital or analog format. Also, the input device 117 can be used to provide user input for controlling the electronic computing device 101 or operational input for controlling aspects of a specific application.

The input device 117 can include one or more sensors 139 and/or one or more other miscellaneous input devices 141. It should be appreciated that the input device 117 is not limited to only providing information. In some embodiments, the input device 117 can also receive information. Such devices can be considered both an input device 117 and an output device 121.

The miscellaneous input device 141 can include a variety of devices or components. In some embodiments, the miscellaneous input devices 141 can include switches such as limit switches, level switches, vacuum switches, pressure switches, or the like, as well as buttons including pushbuttons or the like. In some embodiments, the miscellaneous input devices 141 include user interface components such as a pointing device, for example a mouse, text input devices, for example a keyboard, a touch screen, or the like.

Sensors

Each of the one or more sensors 139 can be used to provide information about a wide variety of measured parameters. In general terms, the sensor 139 is used to measure or detect information about its environment and send the information to the processor 103 and/or the memory 105. In some embodiments, the sensor 139 can operate as a transducer and generate an electrical signal as a function of the measured parameter. The electrical signal is communicated to the processor 103 and/or the memory 105 where it can be used for a variety of purposes.

The sensor 139 can be a digital sensor and/or an analog sensor. For example, in some embodiments, the sensor 139 provides digital information to the processor 103 and/or the memory 105. In other embodiments, the sensor 139 provides analog information to the processor 103 and/or the memory 105. Also, in some embodiments, the information can be converted from one type to the other—e.g., from digital to analog or from analog to digital.

The sensor 139 can measure the parameter directly (i.e., direct measurement) or indirectly (i.e., indirect measurement). A direct measurement sensor directly measures the parameter itself. An indirect measurement sensor measures a secondary parameter that can be translated into the parameter of interest.

The sensor 139 can communicate information to the processor 103 and/or the memory 105 in a variety of ways and/or using a variety of protocols. In some embodiments, the sensor 139 can be a protocol-based sensor that uses a protocol to communicate with the processor 103 and/or the memory 105, or it can be a non protocol-based sensor that does not use a protocol to communicate with the processor 103 and/or the memory 105. A protocol-based sensor communicates with the processor 103 by sending a data stream by way of a communication protocol. In some embodiments, the protocol-based sensor includes a separate processor that is part of the sensor and used to communicate using the protocol.

It should be appreciated that the information provided by the sensor 139 can be used in a variety of ways by the processor 103. For example, in some embodiments, the processor 103 can compare the information to a set point. In some embodiments, analog information is amplified before being compared to the set point.

In some embodiments, the sensor 139 can be used to measure one or more parameters. For example, the sensors 139 can be used to measure temperature, position, angle, displacement, recoil energy, distance, speed, velocity, direction, and/or acceleration of a projectile and/or the firearm 10, and/or the suppressor system 100.

Temperature Sensors

In some embodiments, the sensor 139 is a temperature sensor used to measure the temperature of the internal and/or external components of the suppressor 100 or the firearm 10 and/or other environmental or ambient temperatures. Temperature is the physical quantity expressing the thermal energy present in matter. In some embodiments, the temperature sensor acts as a transducer and generates an electrical signal as a function of the measured temperature.

The temperature sensor can be a contact type temperature sensor or a non-contact type temperature sensor. Contact type temperature sensors are positioned in physical contact with the material and rely primarily on conduction to detect changes in its temperature. Non-contact type temperature sensors are not positioned in physical contact with the material and rely primarily on convection and/or radiation to detect changes in its temperature.

The temperature sensor can be any of a variety of types of temperature sensors. For example, suitable temperature sensors include thermocouples (type K, J, T, E, N, S, R, or the like), resistance temperature detectors (RTDs), thermistors, bimetallic strips, semiconductor temperature sensors, thermometers, vibrating wire temperature sensors, infrared temperature sensors, or the like.

Pressure Sensors

In some embodiments, the sensor 139 is a pressure sensor used to measure the internal pressure of gasses resulting from a fired projectile. In some embodiments, the sensor 139 is a pressure sensor that measures the dissipation of the gas pressure over time. Pressure is an expression of the force required to stop the gas from expanding and is expressed in force per unit area. In some embodiments, the pressure sensor acts as a transducer and generates an electrical signal as a function of the measured pressure.

The pressure sensor can be configured to measure a variety of pressures. In some embodiments, the pressure sensor is an absolute pressure sensor configured to measure the pressure relative to a vacuum. In some embodiments, the pressure sensor is a gauge pressure sensor configured to measure the pressure relative to ambient atmospheric pressure. In some embodiments, the pressure sensor is a differential pressure sensor configured to measure the difference between two pressures. In some embodiments, the pressure sensor is a sealed pressure sensor configure to measure the pressure relative to some fixed pressure other than ambient atmospheric pressure.

The pressure sensor can use a variety of pressure sensing technologies. In some embodiments, the pressure sensor can use force collecting pressure sensing technology. These types of electronic pressure sensors use a force collector such as a diaphragm, piston, bourdon tube, bellows, or the like, to measure strain or deflection due to applied force over an area. Examples of suitable force collector pressure sensors includes piezoresistive strain gauge pressure sensors, capacitive pressure sensors, electromagnetic pressure sensors, piezoelectric pressure sensors, strain-gauge pressure sensors, optical pressure sensors, potentiometric pressure sensors, force balancing pressure sensors, or the like. In some embodiments, the pressure sensor can use other properties such as density to infer pressure of a gas.

Position Sensors

In some embodiments, the sensor 139 is an accelerometer and/or position sensor configured to measure the position of the firearm prior to firing, and the resulting arc reaction after firing for an indication of muzzle rise. One or more position sensors may be used to locate the firearm in space referenced to parallel or close parallel of a surface wherein the surface may be the ground or surface the firearm operator is supported by or a surface the firearm is supported by. As a projectile is fired, the position sensor may measure the rise (recoil) reaction of the firearm as the firearm operator raises the firearm up and returns to parallel or close parallel. The angle between parallel and close parallel may be measured and utilized in any data analysis related to position of the firearm. This information may be useful for a firearm operator to understand and gain better control of the firing system. The position sensor can be used to determine the absolute position or location of the component or the relative position or displacement of the component in terms of linear travel, rotational angle, or three-dimensional space. In some embodiments, the position sensor acts as a transducer and generates an electrical signal as a function of the measured position.

The position sensor can be a contact type position sensor or a non-contact type position sensor. Contact type position sensors are positioned in physical contact with the component to detect changes in its position. Non-contact type position sensors can detect changes in the position of the component without being in physical contact with it.

The position sensor can be any of a variety of types of position sensors and can be used to measure a variety of positions or movements including linear, rotary, and/or angular positions or movements. For example, suitable position sensors include potentiometric position sensors, inductive position sensors such as a linear variable differential transformer or a rotary variable differential transformer, eddy current-based position sensors, capacitive position sensors, magnetostrictive position sensors, hall effect-based magnetic position sensors, fiber optic position sensors, optical position sensors, ultrasonic position sensors, or the like.

Light Sensors

In some embodiments, the sensor 139 is a light sensor configured to measure muzzle flash and or/an overall light signature from a fired projectile. The light sensor can be used to determine the presence and/or intensity of light by measuring the radiant energy that exists in a certain range of frequencies, which typically include the infrared, visible, and/or ultraviolet light spectrum. In some embodiments, the light sensor acts as a transducer and generates an electrical signal as a function of the measured radiant energy.

The light sensor can include a variety of different light sensing technologies. In some embodiments, the light sensor generates electricity when illuminated. Examples of such light sensors include photovoltaic light sensors and photoemissive light sensors. In some embodiments, the light sensor changes its electrical properties when illuminated. Examples of such light sensors include photoresistor light sensors and photoconductor light sensors.

Image Sensors

In some embodiments, the sensor 139 is an image sensor configured to measure muzzle flash and or/an overall light signature from a fired projectile. In general, an image sensor is a device that detects and conveys information used to make an image. The image sensor converts the variable attenuation of radiation waves (infrared, visible, and/or ultraviolet spectrum radiation as well as other frequencies) into signals that convey the information.

The image sensor can be any of a variety of types of image sensors. For example, suitable image sensors include electronic image sensors such as a charge-coupled device (CCD), active-pixel sensor (CMOS sensor), or the like. The image sensor can be part of a camera or other imaging device.

Output Devices

Each of the one or more output devices 121 is a physical component that receives information from the processor 103 and/or the memory 105. The output device 121 can be communicatively linked to the system bus 107 by way of one or more output interfaces 123. The output device 121 can be any suitable type and can receive any of a variety of information. For example, the output device 121 can be a digital and/or analog device and can receive information in a digital and/or analog format. Also, the output device 121 can be used to provide information to the user or perform various operations related to the specific application.

The output device 121 can include one or more actuators 143 and/or one or more other miscellaneous output devices 145. It should be appreciated that the output device 121 is not limited to only receiving information. In some embodiments, the output device 121 can also send information. Such devices can be considered both an output device 121 and an input device 117.

The miscellaneous output devices 145 can include a variety of devices or components. In some embodiments, the miscellaneous output devices 145 can include audio output devices such as speakers as well as other output devices.

Actuators

Each of the one or more actuators 143 can be used to activate movement or an operation. In general terms, the actuator 143 is used to activate something in response to an instruction or control signal sent from the processor 103. In some embodiments, the actuator 143 can act as a transducer by receiving an electrical signal and transforming it into the desired movement or operation.

The information received by the actuator 143 can take a variety of forms and use a number of technologies. For example, the information may be in the form of an electric voltage or current, expanding gas pressure, binary data, or the like. The information can be provided as digital and/or analog format. For example, in some embodiments, the actuator 143 receives digital information from the processor 103 or other component(s) in the electronic computing device 101. In other embodiments, the actuator 143 receives analog information from the processor 103 or other component(s) in the electronic computing device 101. Also, in some embodiments, the information received by the actuator 143 can be converted from one type to the other—e.g., from digital to analog or from analog to digital.

The actuator 143 can use a variety of energy sources to operate. For example, the actuator 143 can operate using electrical energy, hydraulic energy, pneumatic energy, thermal energy, magnetic energy, or the like. Likewise, the actuator 143 can be an electric actuator, hydraulic actuator, pneumatic actuator, thermal actuator, magnetic actuator, or the like. The actuator 143 can also be used to produce a variety of movements. For example, the actuator 143 can be used to produce linear movement and/or rotary movement.

Motors

In some embodiments, the actuator 143 can include an electric motor. In general, the electric motor is a device that converts electrical energy to mechanical energy. In some embodiments, the mechanical energy produced by the electric motor is in the form of the rotation of a shaft. The mechanical energy can be used directly or converted into other mechanical movement using levers, gears, ratchets, cams, or the like. The motor can be a DC motor or an AC motor.

Relays

In some embodiments, the actuator 143 can include a relay. In general, a relay is an electrically operated switch. In some embodiments, the relay includes one or more input terminals to receive information or control signals and one or more operating contact terminals electrically linked to a separate electrical device.

In some embodiments, the relays can include electromechanical relays having contacts that mechanically open and close. For example, the relay can include an electromagnet that opens and closes the contacts. In other embodiments, the relays can include solid state relays that use semiconductor properties to control the on or off state of the relay without any moving parts. Solid state relays can include thyristors and transistors to switch currents up to a hundred amps or more.

Communication Devices

Each of the communication devices 125 is a physical component that allows the electronic computing device 101 to communicate with other devices, components, and/or networks. The communication device can be communicatively linked to the system bus 107 by way of one or more communication interfaces 127. The communication device 125 can include one or more wired communication devices 147 and/or one or more wireless communication devices 149.

It should be appreciated that the communication device 125 can be any suitable physical device. For example, in some embodiments, the communication device 125 is a network interface controller used to connect the electronic computing device 101 to a larger network such as a local area network (LAN), wide area network (WAN), or the Internet.

It should also be appreciated that the communication device 125 can use a variety of communication protocols. For example, in some embodiments, the wired communication device 147 can use communication protocols such as Ethernet, RS-232, RS-485, USB, or the like. Also, in some embodiments, the wireless communication devices 149 can use communication protocols such as Wi-Fi, Bluetooth, Zigbee, LTE, 5G, or the like.

Power Source

The power source 129 can be used to supply electric power to the electronic computing device 101. The power source 129 can provide any suitable type of power including AC power, DC power, or the like. The power source 129 can obtain power from any suitable source including an AC power source (standard wall outlet), DC power source (a transformer plugged into a wall outlet), battery, generator, or the like.

In some embodiments, the power source 129 includes a power supply that converts electric current from a source to a desired voltage, current, and/or frequency to power the electronic computing device 101. In some embodiments, the power supply can convert AC power ranging from 110-240 VAC to DC power ranging from 6-60 VDC.

Circuit Board

The electronic computing device 101 can include one or more circuit boards (alternatively referred to as logic boards) to which one or more of the components can be coupled. For example, the processor 103, the memory 105, the storage device 109, the display device 113, the input device 117, the output device 121, the communication device 125, and/or the power source 129 can be coupled to one or more circuit boards. In some embodiments, the processor 103, the memory 105, and/or the storage device 109 can be coupled to one circuit board.

In some embodiments, the circuit board can contain a series of conductive tracks, pads, and/or other features etched from one or more sheet layers of copper laminate laminated onto and/or between sheet layers of nonconductive substrate. The conductive features can be part of the system bus 107 communicatively linking the various components of the electronic computing device 101. In some embodiments, the circuit board can be a printed circuit board. In some embodiments, the circuit board can be a motherboard.

Multiple Electronic Computing Devices Communicatively Linked

Figure 13:
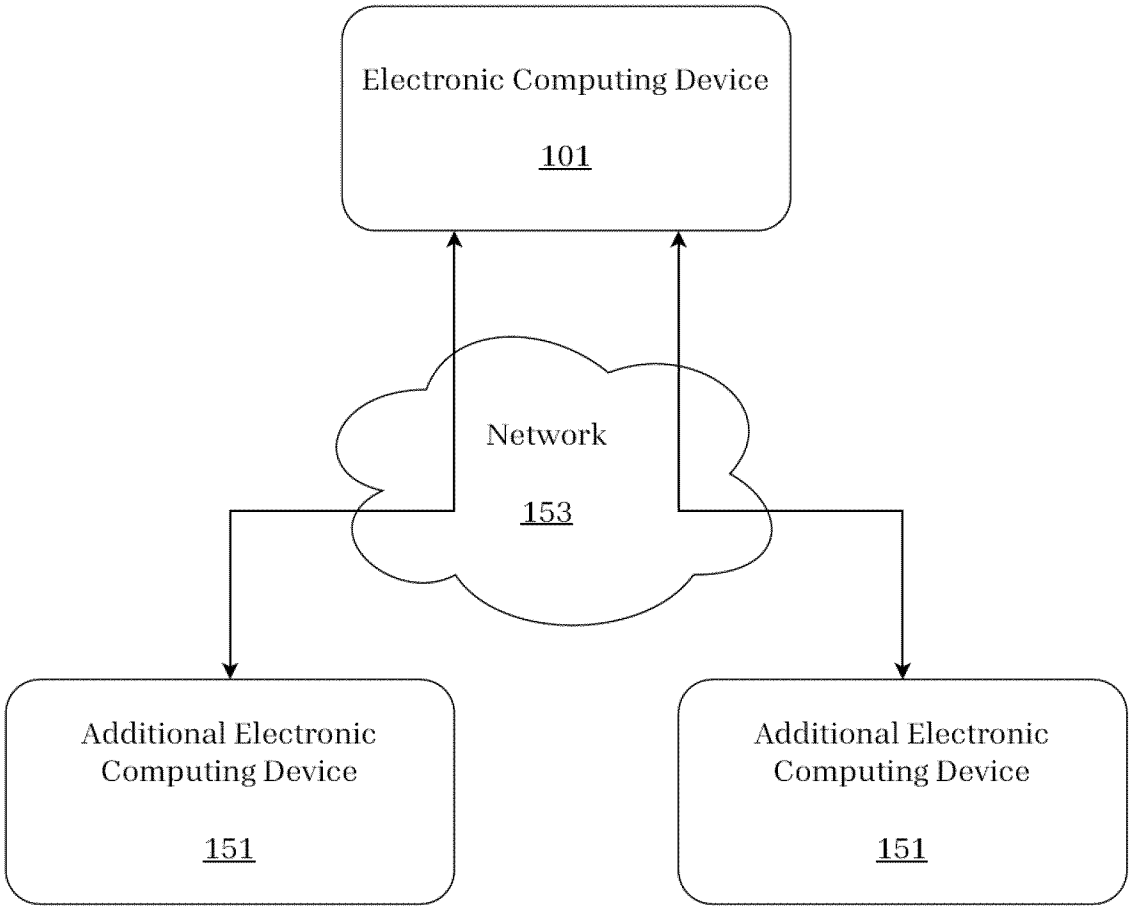
FIG. 13 shows various embodiments of the electronic computing device in FIG. 10 communicatively linked to one or more additional electronic computing devices by way of a network.

Referring to FIG. 13, The electronic computing device 101 can be communicatively linked to and/or controlled by one or more additional electronic computing devices 151. For example, the additional electronic computing device(s) 151 can be used to send data to or receive data from the electronic computing device 101. The additional electronic computing device(s) 151 can also be used to control or operate the electronic computing device 101. For example, the additional electronic computing device(s) 151 can be used to control the electronic computing device 101 to perform any of the methods, processes, or other operations described above.

The additional electronic computing device(s) 151 can be the same as or similar to the electronic computing device 101. The additional electronic computing device(s) 151 can also be a different device than the electronic computing device 101 even though it can have any of the components and/or features described in connection with the electronic computing device 101. The additional electronic computing device 151 can be a mobile electronic computing device, a personal electronic computing device, a wearable electronic computing device, a general-purpose electronic computing device, a special-purpose electronic computing device (e.g., designed for a specific purpose, application, or field of applications), an industrial electronic computing device, or the like.

By way of example, the additional electronic computing device 151 can be a mobile electronic computing device such as a mobile phone, smartphone, tablet computer, handheld personal computer, or the like. The additional electronic computing device 151 can also be a personal electronic computing device such as a laptop computer, desktop computer, or workstation. The additional electronic computing device 151 can also be a wearable electronic computing device such as a smartwatch, smartband, smartglasses, or the like. The additional electronic computing device 151 can also be an industrial electronic computing device such as a programmable logic controller, system on a module, or the like.

The electronic computing device 101 can be communicatively linked with the additional electronic computing device(s) 151 using any suitable wired or wireless communication protocol. For example, the electronic computing devices 101, 151 can communicate using one or more of the following wired communication protocols: ethernet, HDMI, SATA, CAN, RS-232, RS-485, UART, USART, USB, or the like. The electronic computing devices 101, 151 can communicate using one or more of the following wireless communication protocols: Wi-Fi, Bluetooth, Bluetooth Low Energy, Zigbee, Z-wave, GSM/GPRS, CDMA, NFC, RFID, 6LoWPAN, or the like.

The additional electronic computing device(s) 151 can be connected directly to the electronic computing device 101 without connecting to any intermediate electronic computing devices, or the additional electronic computing device(s) 151 can be connected to the electronic computing device 101 by way of one or more intermediate electronic computing devices—e.g., a network 153. Likewise, the additional electronic computing device(s) 151 can be positioned adjacent to or nearby the electronic computing device 101 (e.g., same room, line of sight, etc.), or it can be positioned remotely relative to the electronic computing device 101 (e.g., different rooms, out of sight, different continents, etc.).

In one example, the additional electronic computing device 151 can be a mobile electronic computing device capable of running applications obtained from an app source (e.g., an app store) including an application designed to communicate with and/or control the electronic computing device 101. In another example, the additional electronic computing device 151 can be a personal electronic computing device such as a laptop computer capable of running software designed to communicate with and/or control the electronic computing device 101. It should be appreciated that there are numerous other ways the additional electronic computing device 151 can connect to, communicate with, and/or control the electronic computing device 101.

Network Computing

One or more of the electronic computing devices 101, 151 can be part of or communicatively linked to a network 153 of computing devices having a variety of topologies. The network 153 can include a local area network (LAN), wide area network (WAN) or the Internet. The electronic computing devices 101, 151 on the network 153 can be similar and/or dissimilar to each other. The program instructions described above can be implemented by a single electronic computing device 101, 151 or by multiple electronic computing devices 101, 151 communicatively linked over the network 153.

The one or more electronic computing devices 101, 151 can be part of a wide variety of computer systems. In some embodiments, the one or more electronic computing devices 101, 151 can be part of or communicatively linked to a cloud computing environment. Cloud computing refers to a model for enabling ubiquitous, convenient, on-demand network access to a shared pool of configurable computing resources (e.g., networks, servers, storage, applications, and/or services) that can be rapidly provisioned via virtualization and released with minimal management effort or service provider interaction, and then scaled accordingly. A cloud computing environment can have a variety of characteristics (e.g., on-demand self-service, broad network access, resource pooling, rapid elasticity, measured service, etc.), service models (e.g., software as a service ("SaaS"), platform as a service ("PaaS"), infrastructure as a service ("IaaS")), and deployment models (e.g., private cloud, community cloud, public cloud, hybrid cloud, etc.).

The one or more electronic computing devices 101, 151 can communicate with each other using a variety of network protocols—i.e., a set of rules for formatting and processing data. The use of network protocols makes it possible for electronic computing devices 101, 151 having vastly different software and hardware to communicate with each other.

Network Interconnection Model

In general, network protocols take complex processes and divide them into smaller tasks or functions. These functions work at different layers of a network hierarchy to fulfill certain tasks that contribute to the overall operations of a network. Although there are different types of networks that use different protocol sequences, one common structure is based on the Open Systems Interconnection (OSI) model. The OSI model includes one or more of the following seven layers.

- Physical layer: this is the first layer and it includes the tangible electronic computing device 101, 151 and its mechanical characteristics, which allow it to connect with a network.
- Data link layer: the second layer handles data packaging by creating data packets, detecting packet transmission errors, and correcting the packet transmission errors.
- Network layer: the third network layer manages the routes the electronic computing devices 101, 151 use to transfer data and controls how information travels along the network to prevent congestion and improve efficiency.
- Transport layer: this layer is the fourth layer, where protocols manage the delivery of data packages over the network. Protocols at this layer can also recover or troubleshoot errors.
- Session layer: layer five protocols handle user sessions by starting new sessions, ending completed sessions, and displaying dialogues for users to interact within the interface.
- Presentation layer: the sixth layer of a network contains protocols that translate data from one format into another. For example, a first electronic computing device 101, 151 may send data to a second electronic computing device 101, 151 using a different coding or encryption type than that used by the second electronic computing device 101, 151. This layer decodes the data into a format that the second electronic computing device 101, 151 can use.
- Application layer: the application layer uses protocols that provide services like file transfers and operations.

At each layer of the network, protocols determine how to carry out specific tasks. Multiple protocols can operate at each layer to initiate, coordinate, and fulfill each function. In an OSI, the lower layers of the network focus primarily on the transport of data between the electronic computing devices 101, 151. The higher layers—i.e., the session layer, presentation layer, and application layer—manage data application.

The following is a list of common classifications of network protocols with examples of each:

Network Communication Protocols

A network communication protocol allows basic data transfers between networked electronic computing devices 101, 151. These protocols can communicate text-based files between two or more electronic computing devices 101, 151 or over a larger network such as the internet. They can also establish communication between routers and external or linked electronic computing devices 101, 151 in a network. Examples of network communication protocols include:

- Bluetooth: A Bluetooth protocol can connect electronic computing devices 101, 151 that perform the same or different functions to each other. Examples of such electronic computing devices 101, 151 include laptops, mobile phones, cameras, printers, and tablets.
- File transfer protocol (FTP): FTP protocols allow electronic computing devices 101, 105 to share files between hosts. They enable the electronic computing devices 101, 105 to share large files, resume sharing after an interruption, recover lost files, and schedule file transfers.
- Transmission control protocol/internet protocol (TCP/IP): this protocol provides reliable delivery to applications and ensures that the message arrives at the correct location, on time and without duplication.
- User datagram protocol (UDP): UDP is an alternative to TCP and also works with IP to transmit time-sensitive data. UDP allows low-latency data transmissions between network applications, making it especially suitable for VoIP or other audio and video requirements.
- Hypertext transfer protocol (HTTP): a protocol used for distributed and collaborative hypermedia information systems that allow for sharing data like text files, images, and videos over the internet.
- Simple mail transfer protocol (SMTP): the SMTP transfers emails between electronic computing devices 101, 105 and notifies the user of incoming electronic messages.
- Address resolution protocol (ARP): ARP translates IP addresses to MAC addresses and vice versa so LAN endpoints can communicate with one another. ARP is used because IP and MAC addresses are different lengths.
- Domain name system (DNS): DNS is a database that includes a website's domain name and its corresponding IP addresses. DNS translates a domain name into IP addresses. DNS also includes the DNS protocol, which is within the IP suite and details the specifications DNS uses to translate and communicate.
- Dynamic host configuration protocol (DHCP): DHCP assigns IP addresses to network endpoints so they can communicate with other network endpoints over IP. Whenever an electronic computing device 101, 105 joins a network with a DHCP server for the first time, DHCP automatically assigns it an IP address and continues to do so each time an electronic computing device 101, 105 moves locations on the network.

Network Security Protocols

These protocols ensure that data transmitted over a network remains secure. They prevent unauthorized users from accessing information by incorporating passwords, authentication systems, or data encryption. Encryption is the process that converts plain or standard text into a coded form so that unauthorized users can't read it. Network security protocols include:

Hypertext transfer protocol secure (HTTPS): this protocol works similarly to HTTP but uses encryption to ensure the secure communication of data over a network like the internet.

Secure sockets layer/transport layer security (SSL/TLS): SSL and TLS protocols also use encryption to secure information transferred between two electronic computing devices 101, 105 in a network. TLS is the most recent version of this protocol, though the term "SSL" is still often used to refer to this type of protocol.

Secured shell (SSH): the SSH protocol provides secure connections to a network and is the primary method of managing network devices at the command level, which is the level at which the user can control the operating system of an electronic computing device 101, 105.

Secure file transfer protocol (SFTP): SFTP allows for secure file access, transfer and management over a network.

Network Management Protocols

Network management protocols define the procedures used to operate a network. This includes how networks function and their maintenance requirements. Management protocols apply to all the electronic computing devices 101, 105 in a network, including routers, servers, and computers. They coordinate operations between all the electronic computing devices 101, 105.

Network management protocols are important for maintaining the stability of connections between electronic computing devices 101, 105 in a network and the connections of individual electronic computing devices 101, 105 to the network. A user can implement a network protocol to troubleshoot issues with connectivity. Types of network management protocols include:

Simple network management protocol (SNMP): SNMP allows network administrators to evaluate a network's performance, identify network errors and troubleshoot problems.

Internet control message protocol (ICMP): this protocol can send error messages and information about an electronic computing device 101, 105 or a network's operations. They can announce an error and assist with troubleshooting tasks.

Telnet: Telnet works similarly to SSH. It is a method of managing electronic computing devices 101, 105 at the command level, but unlike SSH, it doesn't provide a secure connection to a network.

General Terminology and Interpretative Conventions

Articles such as "the," "a," and "an" shall be interpreted as connoting the singular or plural. Also, the word "or" when used without a preceding "either" (or other similar language indicating that "or" is unequivocally meant to be exclusive—e.g., only one of x or y, etc.) shall be interpreted to be inclusive (e.g., "x or y" means one or both x or y).

The term "and/or" shall also be interpreted to be inclusive (e.g., "x and/or y" means one or both x or y). In situations where "and/or" or "or" are used as a conjunction for a group of three or more items, the group shall be interpreted to include one item alone, all the items together, or any combination or number of the items.

The phrase "based on" shall be interpreted to refer to an open set of conditions unless unequivocally stated otherwise (e.g., based on only a given condition). For example, a step described as being based on a given condition can be based on the recited condition and one or more unrecited conditions.

The term "can," when used as an auxiliary verb, shall refer to an optional or noncompulsory capability of the described subject matter that is not required to be present in any given embodiment.

The terms have, having, contain, containing, include, including, and characterized by shall be interpreted to be synonymous with the terms comprise and comprising—i.e., the terms are inclusive or open-ended and do not exclude additional unrecited subject matter. The use of these terms shall also be understood as disclosing and providing support for narrower alternative embodiments where these terms are replaced by "consisting of," "consisting of the recited subject matter plus impurities and/or trace amounts of other materials," or "consisting essentially of."

Certain features described in the context of separate embodiments can also be implemented in combination in a single embodiment. Conversely, various features described in the context of a single embodiment can also be implemented in multiple embodiments separately or in any suitable subcombination. Moreover, although features may be described in certain combinations and even initially claimed as such, one or more features from a claimed combination can be excised from the combination, and the claimed combination may be directed to a subcombination or variation of a subcombination.

Many aspects or features are described as being optional, e.g. through the use of the term "can" or otherwise. For the sake of brevity and legibility, this document does not explicitly recite each combination and/or permutation that may be obtained by choosing from the set of optional aspects or features. However, this document is to be interpreted as explicitly disclosing all such combinations and/or permutations. For example, something described as having three optional aspects may be embodied in seven different ways, namely with only one of the three aspects, with any two of the three aspects, or with all three of the aspects.

Any methods described in this document should not be interpreted to require the steps to be performed in a specific order unless expressly stated otherwise or doing so is literally impossible. The methods should also be interpreted to provide support to perform the recited steps in any sequence unless expressly stated otherwise.

The example configurations described in this document do not represent all the examples that may be implemented or that are within the scope of the claims. The term "example" shall be interpreted to mean "serving as an example, instance, or illustration," and not "preferred" or "advantageous over other examples."

Unless otherwise indicated, all numbers or expressions, such as those expressing dimensions, physical characteristics, or the like, used in the specification (other than the claims) are understood to be modified in all instances by the term "approximately." At the very least, and not as an attempt to limit the application of the doctrine of equivalents to the claims, each numerical parameter recited in the specification or claims which is modified by the term "approximately" should be construed in light of the number of recited significant digits and/or by applying ordinary rounding techniques.

All disclosed ranges are to be understood to encompass and provide support for claims that recite any subranges or any individual values subsumed by each range. For example, a stated range of 1 to 10 should be considered to include and provide support for claims that recite any subranges or individual values that are between and/or inclusive of the minimum value of 1 and the maximum value of 10; that is, all subranges beginning with a minimum value of 1 or more and ending with a maximum value of 10 or less (e.g., 5.5 to 10, 2.34 to 3.56, and so forth) or any values from 1 to 10 (e.g., 3, 5.8, 9.9994, and so forth), which values can be expressed alone or as a minimum value (e.g., at least 5.8) or a maximum value (e.g., no more than 9.9994).

All disclosed numerical values are to be understood as being variable from 0-100% in either direction and thus provide support for claims that recite such values (either alone or as a minimum or a maximum—e.g., at least <value> or no more than <value>) or any ranges or subranges that can be formed by such values. For example, a stated numerical value of 8 should be understood to vary from 0 to 16 (100% in either direction) and provide support for claims that recite the range itself (e.g., 0 to 16), any subrange within the range (e.g., 2 to 12.5) or any individual value within that range expressed individually (e.g., 15.2), as a minimum value (e.g., at least 4.3), or as a maximum value (e.g., no more than 12.4).

The terms recited in the claims should be given their ordinary and customary meaning as determined by reference to relevant entries in widely used general dictionaries and/or relevant technical dictionaries, commonly understood meanings by those in the art, etc., with the understanding that the broadest meaning imparted by any one or combination of these sources should be given to the claim terms (e.g., two or more relevant dictionary entries should be combined to provide the broadest meaning of the combination of entries, etc.) subject only to the following exceptions: (a) if a term is used in a manner that is more expansive than its ordinary and customary meaning, the term should be given its ordinary and customary meaning plus the additional expansive meaning, or (b) if a term has been explicitly defined to have a different meaning by reciting the term followed by the phrase "as used in this document shall mean" or similar language (e.g., "this term means," "this term is defined as," "for the purposes of this disclosure this term shall mean," etc.). References to specific examples, use of "i.e.," use of the word "invention," etc., are not meant to invoke exception (b) or otherwise restrict the scope of the recited claim terms. Other than situations where exception (b) applies, nothing contained in this document should be considered a disclaimer or disavowal of claim scope.

None of the limitations in the claims shall be interpreted as invoking 35 U.S.C. 112(f) unless the words "means for" or "step for" are explicitly recited in the claim.

Unless explicitly stated otherwise or otherwise apparent from context, terms such as "processing," "computing," "calculating," "determining," "displaying," or the like, refer to the action and processes of an electronic computing device including a processor and memory.

The subject matter recited in the claims is not coextensive with and should not be interpreted as coextensive with any embodiment, feature, or combination of features described or illustrated in this document. This is true even if only a single embodiment of the feature or combination of features is illustrated and described.

Joining or Fastening Terminology and Interpretative Conventions

The term "coupled" means the joining of two members directly or indirectly to one another. Such joining may be stationary in nature or movable in nature. Such joining may be achieved with the two members or the two members and any additional intermediate members being integrally formed as a single unitary body with one another or with the two members or the two members and any additional intermediate member being attached to one another. Such joining may be permanent in nature or alternatively may be removable or releasable in nature.

The term "coupled" includes joining that is permanent in nature or releasable and/or removable in nature. Permanent joining refers to joining the components together in a manner that is not capable of being reversed or returned to the original condition. Releasable joining refers to joining the components together in a manner that is capable of being reversed or returned to the original condition.

Releasable joining can be further categorized based on the difficulty of releasing the components and/or whether the components are released as part of their ordinary operation and/or use. Quickly releasable joining (i.e., quick-release) refers to joining that that can be released without the use of tools. Readily or easily releasable joining refers to joining that can be readily, easily, and/or promptly released with little or no difficulty or effort. Some joining can qualify as both quickly releasable joining and readily or easily releasable joining. Other joining can qualify as one of these types of joining but not the other. For example, one type of joining may be readily or easily releasable but also require the use of a tool.

Non-quickly releasable joining (i.e., non-quick-release) refers to joining that can only be released with the use of tools. Difficult or hard to release joining refers to joining that is difficult, hard, or arduous to release and/or requires substantial effort to release. Some joining can qualify as both non-quickly releasable joining and difficult or hard to release joining. Other joining can qualify as one of these types of joining but not the other. For example, one type of joining may require the use of a tool but may not be difficult or hard to release.

The joining can be released or intended to be released as part of the ordinary operation and/or use of the components or only in extraordinary situations and/or circumstances. In the latter case, the joining can be intended to remain joined for a long, indefinite period until the extraordinary circumstances arise.

It should be appreciated that the components can be joined together using any type of fastening method and/or fastener. The fastening method refers to the way the components are joined. A fastener is generally a separate component used in a mechanical fastening method to mechanically join the components together. A list of examples of fastening methods and/or fasteners is given below. The list is divided according to whether the fastening method and/or fastener is generally permanent, readily released, or difficult to release. A general reference to fastening or fasteners without specifying a particular fastening method(s) or fastener(s) should be interpreted as including any type of fastening method and/or fastener.

Examples of permanent fastening methods include welding, soldering, brazing, crimping, riveting, stapling, stitching, some types of nailing, some types of adhering, and some types of cementing. Examples of permanent fasteners include some types of nails, some types of dowel pins, most types of rivets, most types of staples, stitches, most types of structural ties, and toggle bolts.

Examples of readily releasable fastening methods include clamping, pinning, clipping, latching, clasping, buttoning, zipping, buckling, and tying. Examples of readily releasable fasteners include snap fasteners, retainer rings, circlips, split pin, linchpins, R-pins, clevis fasteners, cotter pins, latches, hook and loop fasteners (VELCRO), hook and eye fasteners, push pins, clips, clasps, clamps, zip ties, zippers, buttons, buckles, split pin fasteners, and/or confirmat fasteners.

Examples of difficult to release fastening methods include bolting, screwing, most types of threaded fastening, and some types of nailing. Examples of difficult to release fasteners include bolts, screws, most types of threaded fasteners, some types of nails, some types of dowel pins, a few types of rivets, a few types of structural ties.

It should be appreciated that the fastening methods and fasteners are categorized above based on their most common configurations and/or applications. The fastening methods and fasteners can fall into other categories or multiple categories depending on their specific configurations and/or applications. For example, rope, string, wire, cable, chain, or the like can be permanent, readily releasable, or difficult to release depending on the application.

Drawing Related Terminology and Interpretative Conventions

Reference numbers in the drawings and corresponding description refer to identical or similar elements although such numbers may be referenced in the context of different embodiments.

The drawings are intended to illustrate embodiments that are both drawn to scale and/or not drawn to scale. This means the drawings can be interpreted, for example, as showing: (a) everything drawn to scale, (b) nothing drawn to scale, or (c) one or more features drawn to scale and one or more features not drawn to scale. Accordingly, the drawings can serve to provide support to recite the sizes, proportions, and/or other dimensions of any of the illustrated features either alone or relative to each other. Furthermore, all such sizes, proportions, and/or other dimensions are to be understood as being variable from 0-100% in either direction and thus provide support for claims that recite such values or any ranges or subranges that can be formed by such values.

Spatial or directional terms, such as "left," "right," "front," "back," or the like, relate to the subject matter as it is shown in the drawings and/or how it is commonly oriented during manufacture, use, or the like. However, it is to be understood that the described subject matter may assume various alternative orientations and, accordingly, such terms are not to be considered as limiting.

INCORPORATION BY REFERENCE

The entire content of each document listed below is incorporated by reference into this document (the documents below are collectively referred to as the "incorporated documents"). If the same term is used in both this document and one or more of the incorporated documents, then it should be interpreted to have the broadest meaning imparted by any one or combination of these sources unless the term has been explicitly defined to have a different meaning in this document. If there is an inconsistency between any incorporated document and this document, then this document shall govern. The incorporated subject matter should not be used to limit or narrow the scope of the explicitly recited or depicted subject matter.

Priority patent documents incorporated by reference:

U.S. Prov. App. No. 63/560,047, titled "Systems and Methods for Firearm Suppression," filed on 1 Mar. 2024.

What is claimed is:

1. A firearm suppressor structured to be coupled adjacent to and in contact with a receiver of a lever action firearm comprising a barrel extending from the receiver, the firearm suppressor comprising:

a baffle assembly structured to modulate exhaust gases discharged when the lever action firearm is fired, the baffle assembly comprising:

an inner baffle sleeve forming a primary blast chamber; and an outer tube forming a secondary blast chamber;

wherein the outer tube is slidably coupled to the inner baffle sleeve; and wherein the firearm suppressor is structured to entirely enclose the barrel from the receiver to a distal end of the barrel.

2. The firearm suppressor of claim 1 comprising a firearm adapter coupled to the baffle assembly, the firearm adapter being structured to receive a portion of the barrel of the lever action firearm in concentric alignment with the baffle assembly.

3. The firearm suppressor of claim 1 comprising an end cap threaded onto the inner baffle sleeve to compress a baffle stack against an internal barrel nut.

4. The firearm suppressor of claim 1 wherein the lever action firearm includes a tubular magazine extending lengthwise in a direction parallel to the barrel of the lever action firearm.

5. The firearm suppressor of claim 1 wherein the baffle assembly comprises an internal barrel nut, and wherein the inner baffle sleeve is coupled to the internal barrel nut via a slip fit secured with a fastener.

6. The firearm suppressor of claim 1 wherein the firearm suppressor is structured to allow gas to escape only through an opening through which a projectile passes.

7. A firearm suppressor structured to be coupled to a lever action firearm comprising a barrel, a receiver, and a magazine, the firearm suppressor comprising:

a firearm adapter structured to capture the magazine and a portion of the barrel inside the firearm adapter;

a magazine clamp structured to be coupled to the magazine;

an inner baffle sleeve forming a primary blast chamber; and an outer tube slidably coupled to the inner baffle sleeve to form a secondary blast chamber;

wherein the firearm suppressor is structured to entirely enclose the barrel; and wherein the firearm suppressor is structured to contact the receiver.

8. The firearm suppressor of claim 7 wherein the magazine clamp is coupled to the firearm adapter, the firearm adapter being configured to capture the portion of the barrel in a concentric alignment.

9. The firearm suppressor of claim 8 wherein the magazine clamp is structured to maintain alignment between the magazine and the barrel.

10. The firearm suppressor of claim 7 wherein the magazine is a tubular magazine extending lengthwise in a direction parallel to the barrel.

11. The firearm suppressor of claim 7 wherein the magazine clamp nests inside the firearm adapter.

12. The firearm suppressor of claim 7 comprising an internal barrel nut structured to be threaded onto the barrel to operably couple the magazine clamp and the firearm adapter to the barrel and the receiver.

13. A firearm suppressor structured to be coupled to a lever action firearm comprising a barrel and a receiver, the firearm suppressor comprising:

a firearm adapter structured to be coupled to the receiver and capture the barrel;

an inner baffle sleeve forming a primary blast chamber; and an outer tube slidably coupled to the inner baffle sleeve to form a secondary blast chamber;

wherein the firearm suppressor is structured to entirely enclose the barrel of the lever action firearm and contact the receiver.

14. The firearm suppressor of claim 13 comprising an internal barrel nut structured to be threaded onto the barrel of the lever action firearm to secure the firearm suppressor to the lever action firearm.

15. The firearm suppressor of claim 14 comprising an end cap threaded onto the inner baffle sleeve to compress a baffle stack against the internal barrel nut.

16. The firearm suppressor of claim 13 wherein the outer tube abuts the firearm adapter to operably couple the inner baffle sleeve and the outer tube to the firearm adapter and create the secondary blast chamber.

17. The firearm suppressor of claim 13 wherein a bore axis of the barrel is vertically offset from a central horizontal axis of the firearm adapter.

* * * * *